US006677288B2

(12) United States Patent
Feringa et al.

(10) Patent No.: US 6,677,288 B2
(45) Date of Patent: Jan. 13, 2004

(54) TARGETED MOIETIES FOR USE IN BLEACH CATALYSTS

(75) Inventors: Bernard Lucas Feringa, Groningen (NL); Ronald Hage, Vlaardingen (NL); Steven Howell, Bedford (GB); Neil James Parry, Bedford (GB); Johannes Gerardhus Roelfes, Zurich (CH); Cornelis Theodorus Verrips, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 398 days.

(21) Appl. No.: 09/864,950

(22) Filed: May 24, 2001

(65) Prior Publication Data

US 2002/0049146 A1 Apr. 25, 2002

(30) Foreign Application Priority Data

May 31, 2000 (GB) ..... 0013643

(51) Int. Cl.[7] ..... C11D 3/20; C11D 3/26; C11D 3/386; C11D 3/395

(52) U.S. Cl. ..... 510/303; 510/304; 510/305; 510/311; 510/372; 510/374; 510/376; 510/378; 8/111

(58) Field of Search ..... 510/303, 304, 510/305, 311, 372, 374, 376, 378; 8/111

(56) References Cited

U.S. PATENT DOCUMENTS 4,728,455 A 3/1988 Rerek ..... 252/99

FOREIGN PATENT DOCUMENTS

| | | |
|---|---|---|
| DE | 197 21 886 | 5/1997 |
| DE | 19755493 | 12/1997 |
| EP | 0 458 379 | 5/1991 |
| EP | 0 458 398 | 5/1991 |
| EP | 0 909 809 | 9/1998 |
| EP | 0 999 050 | 11/1999 |
| WO | 88/08028 | 10/1988 |
| WO | 95/34628 | 12/1995 |
| WO | 97/48787 | 12/1997 |
| WO | 98/00500 | 1/1998 |
| WO | 98/39098 | 9/1998 |
| WO | 98/39406 | 9/1998 |
| WO | 98/56885 | 12/1998 |
| WO | 99/57154 | 11/1999 |
| WO | 99/57155 | 11/1999 |
| WO | 00/12667 | 3/2000 |
| WO | 00/12808 | 3/2000 |
| WO | 00/36094 | 6/2000 |
| WO | 01/07555 | 2/2001 |

OTHER PUBLICATIONS

GB Search Report.

*Primary Examiner*—Gregory Delcotto
(74) *Attorney, Agent, or Firm*—Milton L. Honig

(57) ABSTRACT

There is provided a targeted bleaching composition comprising an organic substance which forms a complex with a transition metal, the complex catalyzing bleaching of a substrate by a precursor selected from atmospheric oxygen and/or a peroxyl species. The complex is bound to a recognizing portion having a high binding affinity for stains present on fabrics.

17 Claims, No Drawings

TARGETED MOIETIES FOR USE IN BLEACH CATALYSTS

FIELD OF INVENTION

The present invention relates to targeting a stain on a fabric with a bleach catalyst. The invention also relates to a detergent composition comprising a targeted bleach catalyst and to a process for bleaching stains present on a fabric.

BACKGROUND OF INVENTION

EP9803438 (Unilever) discloses the use of a bleaching enzyme, which is capable of generating a bleaching chemical and has a high binding affinity, recognition, for stains present on fabrics. The enzyme comprises an enzyme part capable of generating a bleaching chemical, coupled to a reagent having a high binding affinity, recognition, for stains present on fabrics. An advantage provided by EP9803438 is that the stained part of the garment, typically the minority, is exposed to higher levels of bleach than the unstained part of the garment, typically the majority.

The use of bleaching catalysts for bleaching stains has been developed over recent years. The resent discovery that some catalysts are capable of bleaching effectively with air has recently become the focus of some interest, for example, GB applications: 9906474.3; 9907714.1; and 9907713.3 (all Unilever). Many of the bleaching catalysts are relatively complex molecules that are not cheap to produce. As with any cleaning product a more economical use of active components and effective stain bleaching profile is sought.

It is an object of the present invention to provide a more effective bleaching catalyst over the teachings of GB applications: 9906474.3; 9907714.1; and 9907713.3 (all Unilever) and other bleach catalysts per se as found in, for example, GB 9027415.0, DE 19755493, EP 999050, WO-A-9534628, EP-A-458379, EP 0909809, U.S. Pat. No. 4,728,455, WO-A-98/39098, WO-A-98/39406 and WO 9748787.

SUMMARY OF INVENTION

The present invention provides a means for bleaching stains on a fabric using a targeted bleach catalyst.

The bleach catalyst is bound to an antibody, the antibody having a selective affinity, recognition, for at least one type of stain. In this manner, a targeted bleach catalyst is held close to the stain thus enhancing bleaching activity over that of non-targeted bleach molecules. The bleach catalyst is either covalently bound to the antibody or bound by antibody recognition of the bleach catalyst. Alternatively, the bleach catalyst is bound to an enzyme; the enzyme is then bound to an antibody that recognises at least one type of stain.

According to a present invention there is provided a bleaching composition comprising an organic substance which forms a complex with a transition metal, the complex catalysing bleaching of a substrate by a precursor selected from atmospheric oxygen, a peroxyl species and a peroxyl species precursor, characterised in that the bleaching composition comprises a recognising portion having a high binding affinity for stains present on a fabric or fabric, wherein in an aqueous solution the organic substance and the recognising portion bind together.

The composition of the present invention may be used in an aqueous or non-aqueous medium, for example, dry cleaning fluids or liquid carbon dioxide.

The present invention extends to a method of bleaching a substrate comprising applying to the substrate, in an aqueous medium, the bleaching composition according to the present invention.

The present invention extends to a commercial package comprising the bleaching composition according to the present invention together with instructions for its use.

The bleach catalysts of the present invention may be a peroxyl species bleach catalyst and/or an oxygen bleach catalyst.

One skilled in the art will appreciate that not all peroxyl activating catalysts are capable of functioning as an oxygen activation catalyst. However, the converse is likely not true. There is no evidence to indicate that any oxygen activation catalyst will not function as peroxyl activating catalyst. In this regard, all oxygen activation catalysts disclosed herein may be used as a peroxyl activating catalyst. Catalysts of the present invention may be incorporated into a composition together with a peroxyl species or source thereof. For a discussion of acceptable ranges of a peroxyl species or source thereof and other adjuvants that may be present the reader is directed to U.S. Pat. No. 6,022,490, the contents of which are incorporated by reference.

When bleaching with atmospheric oxygen or air, it will be appreciated that small amounts peroxyl species may be adventitiously present in a bleaching composition. Nevertheless, the bleaching composition is substantially devoid of peroxygen bleach or a peroxy-based or -a generating bleach systems. By "substantially devoid of peroxygen bleach or peroxy-based or -generating bleach systems" it is meant that the composition contains less than 2%, preferably less than 1%, by molar weight on an oxygen basis, of peroxygen bleach or peroxy-based or -generating bleach system. Preferably, however, the composition will be wholly devoid of peroxygen bleach or peroxy-based or -generating bleach systems when used for bleaching with air.

Thus, at least 10%, preferably at least 50% and optimally at least 90% of any bleaching of the substrate is effected by oxygen sourced from the air.

In the instance that a peroxyl species bleach catalyst is used a peroxyl species may be present in the bleaching composition, or the peroxyl species may be generated in situ. Alternatively, a precursor for a peroxyl species is present in the bleaching composition, for example the glucose oxidase enzyme.

A bleaching composition comprising an oxygen bleach catalyst may be substantially devoid of peroxyl species or precursor thereof. In such a bleaching composition oxygen is the primary source of bleaching species. In order to avoid an overly pedantic construction, an oxygen bleach catalyst together with oxygen should not construed as a peroxyl species precursor as used in this context. Nevertheless, the last statement should not be taken as a binding theory; it is possible that a peroxyl species may be generated from an oxygen bleach catalyst together with oxygen. The targeting of the bleach catalyst is postulated to provide an increase in performance in applications by localising its activity at a desired site. It is likely that benefits of the present invention will include:

(1) decreased non specific interaction of the bleach catalyst with laundry components in the bulk phase;
(2) decreased dosage of a potentially expensive ingredient, i.e. the bleach catalyst;
(3) use of the bleach catalyst only when and where required, i.e., on stain therefore less transition metal will remain on the cloth; and
(4) reduced dye/fabric damage.

A reduction the amount of bleach catalyst per unit dose required over non-targeted bleach catalysts may provide a scenario in which a transition metal complex per se is not provided in the bleach composition. The transition metal complex may be formed in situ during a wash. The transition metal is provided either by the wash liquor or a stain. In many regions of the world the water supply contains substantial levels of transition metal ions, in particular iron. In addition, a stain often contains transition metal ions, in particular iron. Therefore, by having only the organic substance (ligand), i.e., non-complexed, bound to the recognising portion the organic substance becomes activated by 'finding' the metal ions in the wash water, the stain or added metal salt.

A unit dose as used herein is a particular amount of the bleaching composition used for a type of wash. The unit dose may be in the form of a defined volume of liquid, powder, granules or tablet.

DETAILED DESCRIPTION OF THE INVENTION

The targeted bleach catalyst of the present invention recognises a stain by virtue of a recognising portion that is bound to the bleach catalyst. The recognising portion may be an antibody, an enzyme, protein, peptide or the like that has a high binding affinity for a stain. It is within the scope of the present invention for an enzyme part capable of generating a bleaching chemical, a bleach enzyme, to be present. The bleach enzyme may be unbound or bound to the bleach catalyst. As one skilled in the art will appreciate the bleach catalyst, the recognising portion and optionally the bleach enzyme may be bound together before use in solution or bound together in situ during use. The linking/binding of antibodies to enzymes, and organic compounds/complexes is generally a matter of routine and references to such techniques as found in EP 9803438 are applicable to the present invention.

The Bleach Catalyst

The bleach catalyst per se may be selected from a wide range of organic molecules (ligands) and complexes thereof. It will be evident to one skilled in the art how to functionalise an organic molecule (ligand) for tethering (binding) to a recognising portion. As one skilled in the art will appreciate the organic substance (ligand) that forms a complex with a transition metal may be tethered (bound) to the recognising portion via an arm. The arm serves as a spacer between the bleach catalyst and the recognising portion having a high binding affinity for stains present on a fabric. The arm also allows the bleach catalyst sufficient mobility to provide a bleaching action to the stain on the fabric during washing. The arm may be attached to the ligand or complex thereof after synthesis to form a ligand-arm or a complex-arm. Alternatively, a ligand precursor that has an arm is used, as found in the example below. As the ligand is synthesised from the ligand precursor the arm is in place as the ligand is formed. The method or order of attaching/incorporating the arm to the ligand or complex depends upon the chemical nature of the ligand or complex. Functional groups of the arm may require protecting during synthesis of the ligand-arm or the complex-arm to prevent undesirable reactions. For a discussion of protecting groups in organic synthesis the reader is directed to T. W. Green and P. G. M. Wuts, Protective Groups In Organic Synthesis 2nd Ed.; J. Wiley and Sons, 1991.

There are many synthetic routes for providing a ligand-arm or complex-arm and the following examples are provided to exemplify that numerous strategies may be employed. An arm may be attached to a pyridine group as found in the example below or the arm may be attached to another group, for example a hydrocarbyl group or an amine. An example of a possible strategy would be to treat the N4Py ligand (N,N-bis(pyridin-2ylmethyl)-bis(pyridin-2yl)methylamine) with a strong base, for example n-BuLi, followed by treatment with an arm precursor having a leaving group, for example halide, tosylate, or the like, permitting nucleophillic attack that links the N4Py ligand to the arm. The arm precursor having the leaving group most preferably has a protected functional group. The resulting ligand-arm would then be liberated of its protecting group and tethered to the recognising portion.

Suitable organic molecules (ligands) for forming complexes and complexes thereof are found, for example in: GB 9906474.3; GB 9907714.1; GB 98309168.7, GB 98309169.5; GB 9027415.0 and GB 9907713.3; DE 19755493; EP 999050; WO-A-9534628; EP-A-458379; EP 0909809; U.S. Pat. No. 4,728,455; WO-A-98/39098; WO-A-98/39406, WO 9748787, WO 0029537; WO 0052124, and WO0060045 the complexes and organic molecule (ligand) precursors of which are herein incorporated by reference.

The ligand forms a complex with one or more transition metals, in the latter case for example as a dinuclear complex. Suitable transition metals include for example: manganese in oxidation states II–V, iron II–V, copper I–III, cobalt I–III, titanium II–IV, tungsten IV–VI, vanadium II–V and molybdenum II–VI.

The transition metal complex preferably is of the general formula (AI):

$$[M_aL_kX_n]Y_m$$

in which:

M represents a metal selected from Mn(II)–(III)–(IV)–(V), Cu(I)–(II)–(III), Fe(II)–(III)–(IV)–(V), Co(I)–(II)–(II), Ti(II)–(III)–(IV), V(II)–(III)–(IV)–(V), Mo(II)–(III)–(IV)–(V)–(VI) and W(IV)–(V)–(VI), preferably from Fe(II)–(III)–(IV)–(V);

L represents the ligand, preferably N,N-bis(pyridin-2-yl-methyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

Preferably, the complex is an iron complex comprising the ligand N,N-bis(pyridin-2-yl-methyl)-1,1-bis(pyridin-2-yl)-1-aminoethane. Suitable classes of ligands are described below:

(A) Ligands of the general formula (IA):

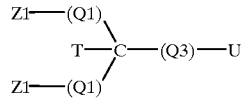

(IA)

wherein

Z1 groups independently represent a coordinating group selected from hydroxy, amino, —NHR or —$N(R)_2$ (wherein R=$C_{1-6}$-alkyl), carboxylate, amido, —NH—C(NH)$NH_2$, hydroxyphenyl, a heterocyclic ring optionally substituted by one or more functional groups E or a heteroaromatic ring optionally substituted by one or more functional groups E, the heteroaromatic ring being selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 and Q3 independently represent a group of the formula:

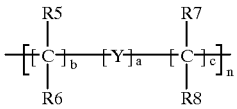

wherein $5 \geqq a+b+c \geqq 1$; a=0–5; b=0–5; c=0–5; n=0 or 1 (preferably n=0);

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I;

T represents a non-coordinated group selected from hydrogen, hydroxyl, halogen, —R and —OR, wherein R represents alkyl, alkenyl, cycloalkyl, heterocycloalkyl, aryl, arylalkyl, heteroaryl or a carbonyl derivative group, R being optionally substituted by one or more functional groups E (preferably T=—H, —OH, methyl, methoxy or benzyl);

U represents either a non-coordinated group T independently defined as above or a coordinating group of the general formula (IIA), (IIIA) or (IVA):

(IIA)

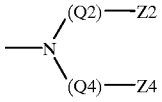

(IIIA)

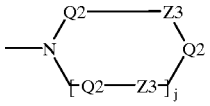

-continued (IVA)

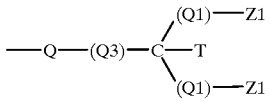

wherein

Q2 and Q4 are independently defined as for Q1 and Q3;

Q represents —N(T)— (wherein T is independently defined as above), or an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Z2 is independently defined as for Z1;

Z3 groups independently represent —N(T)— (wherein T is independently defined as above);

Z4 represents a coordinating or non-coordinating group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, or Z4 represents a group of the general formula (IIAa):

(IIAa)

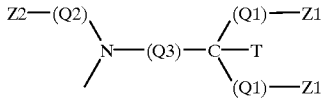

and $1 \leqq j < 4$.

Preferably, Z1, Z2 and Z4 independently represent an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. More preferably, Z1, Z2 and Z4 independently represent groups selected from optionally substituted pyridin-2-yl, optionally substituted imidazol-2-yl, optionally substituted imidazol-4-yl, optionally substituted pyrazol-1-yl, and optionally substituted quinolin-2-yl. Most preferred is that Z1, Z2 and Z4 each represent optionally substituted pyridin-2-yl.

The groups Z1, Z2 and Z4 if substituted, are preferably substituted by a group selected from $C_{1-4}$-alkyl, aryl, arylalkyl, heteroaryl, methoxy, hydroxy, nitro, amino, carboxyl, halo, and carbonyl. Preferred is that Z1, Z2 and Z4 are each substituted by a methyl group. Also, we prefer that the Z1 groups represent identical groups.

Each Q1 preferably represents a covalent bond or C1–C4-alkylene, more preferably a covalent bond, methylene or ethylene, most preferably a covalent bond.

Group Q preferably represents a covalent bond or C1–C4-alkylene, more preferably a covalent bond.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Non-coordinated group T preferably represents hydrogen, hydroxy, methyl, ethyl, benzyl, or methoxy.

In one aspect, the group U in formula (IA) represents a coordinating group of the general formula (IIA):

(IIA)

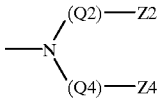

According to this aspect, it is preferred that Z2 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl or optionally substituted benzimidazol-2-yl.

It is also preferred, in this aspect, that Z4 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl, or an non-coordinating group selected from hydrogen, hydroxy, alkoxy, alkyl, alkenyl, cycloalkyl, aryl, or benzyl.

In preferred embodiments of this aspect, the ligand is selected from:

1,1-bis(pyridin-2-yl)-N-methyl-N-(pyridin-2-ylmethyl) methylamine;

1,1-bis(pyridin-2-yl)-N,N-bis(6-methyl-pyridin-2-ylmethyl) methylamine;

1,1-bis(pyridin-2-yl)-N,N-bis(5-carboxymethyl-pyridin-2-ylmethyl)methylamine;

1,1-bis(pyridin-2-yl)-1-benzyl-N,N-bis(pyridin-2-ylmethyl) methylamine; and 1,1-bis(pyridin-2yl)-N,N-bis(benzimidazol-2-ylmethyl) methylamine.

In a variant of this aspect, the group Z4 in formula (IIA) represents a group of the general formula (IIAa):

(IIAa)

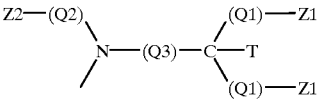

In this variant, Q4 preferably represents optionally substituted alkylene, preferably —$CH_2$—CHOH—$CH_2$— or —$CH_2$—$CH_2$—$CH_2$—. In a preferred embodiment of this variant, the ligand is:

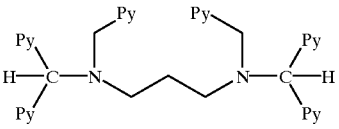

wherein —Py represents pyridin-2-yl.

In another aspect, the group U in formula (IA) represents a coordinating group of the general formula (IIIA):

(IIIA)

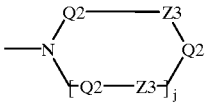

wherein j is 1 or 2, preferably 1.

According to this aspect, each Q2 preferably represents —$(CH_2)_n$— (n=2–4), and each Z3 preferably represents —N(R)— wherein R=—H or $C_{1-4}$-alkyl, preferably methyl.

In preferred embodiments of this aspect, the ligand is selected from:

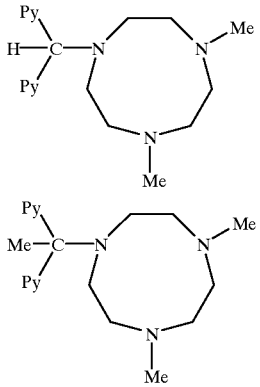

wherein —Py represents pyridin-2-yl.

In yet another aspect, the group U in formula (IA) represents a coordinating group of the general formula (IVA):

(IVA)

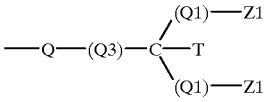

In this aspect, Q preferably represents —N(T)— (wherein T=—H, methyl, or benzyl) or pyridin-diyl.

In preferred embodiments of this aspect, the ligand is selected from:

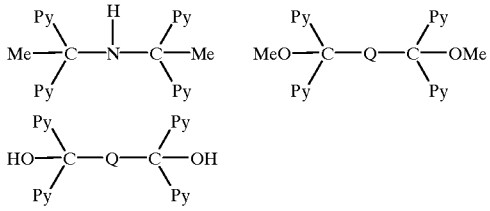

wherein —Py represents pyridin-2-yl, and —Q— represents pyridin-2,6-diyl.

(B) Ligands of the general formula (IB):

(IB)

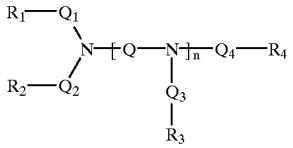

wherein n=1 or 2, whereby if n=2, then each —$Q_3$—$R_3$ group is independently defined;

$R_1$, $R_2$, $R_3$, $R_4$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, Q1, Q2, Q3, Q4 and Q independently represent a group of the formula:

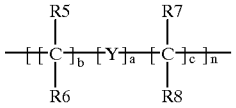

wherein

5≧a+b+c≧1; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least two of $R_1$, $R_2$, $R_3$, $R_4$ comprise coordinating heteroatoms and no more than six heteroatoms are coordinated to the same transition metal atom.

At least two, and preferably at least three, of $R_1$, $R_2$, $R_3$, $R_4$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, substituents for groups $R_1$, $R_2$, $R_3$, $R_4$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

The groups $Q_1$, $Q_2$, $Q_3$, $Q_4$ preferably independently represent a group selected from —$CH_2$— and —$CH_2CH_2$—.

Group Q is preferably a group selected from —$(CH_2)_{2-4}$—, —$CH_2CH(OH)CH_2$—,

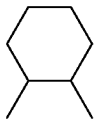

optionally substituted by methyl or ethyl,

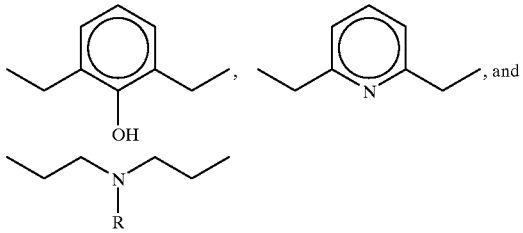

wherein R represents —H or $C_{1-4}$-alkyl.

Preferably, $Q_1$, $Q_2$, $Q_3$, $Q_4$ are defined such that a=b=0, c=1 and n=1, and Q is defined such that a=b=0, c=2 and n=1.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IIB):

(IIB)

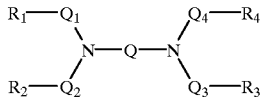

wherein $Q_1$, $Q_2$, $Q_3$, $Q_4$ are defined such that a=b=0, c=1 or 2 and n=1;

Q is defined such that a=b=0, c=2,3 or 4 and n=1; and $R_1$, $R_2$, $R_3$, $R_4$, $R_7$, $R_8$ are independently defined as for formula (I).

Preferred classes of ligands according to this aspect, as represented by formula (IIB) above, are as follows:

(i) ligands of the general formula (IIB) wherein:

$R_1$, R2, $R_3$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

Q is defined such that a=b=0, c=2 or 3 and n=1;

$R_1$, $R_2$, $R_3$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) ligands of the general formula (IIB) wherein:

$R_1$, $R_2$, $R_3$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_4$ represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_4$ represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

(iii) ligands of the general formula (IIB) wherein:

$R_1$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_2$, $R_3$ each independently represent a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_2$, $R_3$ each independently represent a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

Examples of preferred ligands in their simplest forms are:

N,N',N'-tris(3-methyl-pyridin-2-ylmethyl)-ethylenediamine;

N-trimethylammoniumpropyl-N,N',N'-tris(pyridin-2-ylmethyl)-ethylenediamine;

N-(2-hydroxyethylene)-N,N',N'-tris(pyridin-2-ylmethyl)-ethylenediamine;

N,N,N',N'-tetrakis(3-methyl-pyridin-2-ylmethyl)-ethylenediamine;

N,N'-dimethyl-N,N'-bis(pyridin-2-ylmethyl)-cyclohexane-1,2-diamine;

N-(2-hydroxyethylene)-N,N',N'-tris(3-methyl-pyridin-2-ylmethyl)-ethylenediamine;

N-methyl-N,N',N'-tris(pyridin-2-ylmethyl)-ethylenediamine;

N-methyl-N,N',N'-tris(5-ethyl-pyridin-2-ylmethyl)-ethylenediamine;

N-methyl-N,N',N'-tris(5-methyl-pyridin-2-ylmethyl)-ethylenediamine;

N-methyl-N,N',N'-tris(3-methyl-pyridin-2-ylmethyl)-ethylenediamine;

N-benzyl-N,N',N'-tris(3-methyl-pyridin-2-ylmethyl)-ethylenediamine;

N-ethyl-N,N',N'-tris(3-methyl-pyridin-2-ylmethyl)-ethylenediamine;

N,N,N'-tris(3-methyl-pyridin-2-ylmethyl)-N'(2'-methoxy-ethyl-1)-ethylenediamine;

N,N,N'-tris(1-methyl-benzimidazol-2-yl)-N'-methyl-ethylenediamine;

N-(furan-2-yl)-N,N',N'-tris(3-methyl-pyridin-2-ylmethyl)-ethylenediamine;

N-(2-hydroxyethylene)-N,N',N'-tris(3-ethyl-pyridin-2-ylmethyl)-ethylenediamine;

N-methyl-N,N',N'-tris(3-methyl-pyridin-2-ylmethyl) ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl) ethylene-1,2-diamine;

N-ethyl-N,N',N'-tris(5-methyl-pyridin-2-ylmethyl)ethylene-1,2-diamine;

N-benzyl-N,N',N'-tris(5-methyl-pyridin-2-ylmethyl) ethylene-1,2-diamine;

N-(2-hydroxyethyl)-N,N',N'-tris(5-methyl-pyridin-2-ylmethyl)ethylene-1,2-diamine;

N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl)ethylene-1,2-diamine;

N-ethyl-N,N',N'-tris(3-ethyl-pyridin-2-ylmethyl)ethylene-1,2-diamine;

N-benzyl-N,N',N'-tris(3-ethyl-pyridin-2-ylmethyl)ethylene-1,2-diamine;

N-(2-hydroxyethyl)-N,N',N'-tris(3-ethyl-pyridin-2-ylmethyl)ethylene-1,2-diamine;

N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl)ethylene-1,2-diamine;

N-ethyl-N,N',N'-tris(5-ethyl-pyridin-2-ylmethyl)ethylene-1,2-diamine;

N-benzyl-N,N',N'-tris(5-ethyl-pyridin-2-ylmethyl)ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl) ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl)ethylene-1,2-diamine.

(C) Ligands of the general formula (IC):

(IC)

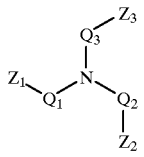

wherein $Z_1$, $Z_2$ and $Z_3$ independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

$Q_1$, $Q_2$, and $Q_3$ independently represent a group of the formula:

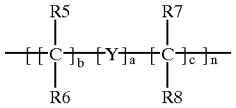

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I.

$Z_1$, $Z_2$ and $Z_3$ each represent a coordinating group, preferably selected from optionally substituted pyridin-2-yl, optionally substituted imidazol-2-yl, optionally substituted imidazol-4-yl, optionally substituted pyrazol-1-yl, and optionally substituted quinolin-2-yl. Preferably, $Z_1$, $Z_2$ and $Z_3$ each represent optionally substituted pyridin-2-yl.

Optional substituents for the groups $Z_1$, $Z_2$ and $Z_3$ are preferably selected from $C_{1-4}$-alkyl, aryl, arylalkyl, heteroaryl, methoxy, hydroxy, nitro, amino, carboxyl, halo, and carbonyl, preferably methyl.

Also preferred is that $Q_1$, $Q_2$ and $Q_3$ are defined such that a=b=0, c=1 or 2, and n=1.

Preferably, each $Q_1$, $Q_2$ and $Q_3$ independently represent $C_{1-4}$-alkylene, more preferably a group selected from —$CH_2$— and —$CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Preferably, the ligand is selected from tris(pyridin-2-ylmethyl)amine, tris(3-methyl-pyridin-2-ylmethyl)amine, tris(5-methyl-pyridin-2-ylmethyl)amine, and tris(6-methyl-pyridin-2-ylmethyl)amine.

(D) Ligands of the general formula (ID):

(ID)

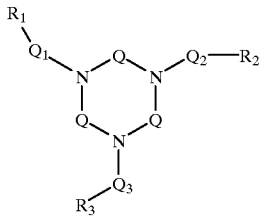

wherein $R_1$, $R_2$, and $R_3$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E;

Q independently represent a group selected from $C_{2-3}$-alkylene optionally substituted by H, benzyl or $C_{1-8}$-alkyl;

$Q_1$, $Q_2$ and $Q_3$ independently represent a group of the formula:

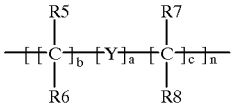

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least one, preferably at least two, of $R_1$, $R_2$ and $R_3$ is a coordinating group.

At least two, and preferably at least three, of $R_1$, $R_2$ and $R_3$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, at least two of $R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

Preferably, substituents for groups $R_1$, $R_2$, $R_3$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

Preferably, $Q_1$, $Q_2$ and $Q_3$ are defined such that a=b=0, c=1,2,3 or 4 and n=1. Preferably, the groups $Q_1$, $Q_2$ and $Q_3$ independently represent a group selected from —$CH_2$— and —$CH_2CH_2$—.

Group Q is preferably a group selected from —$CH_2CH_2$— and —$CH_2CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IID):

(IID)

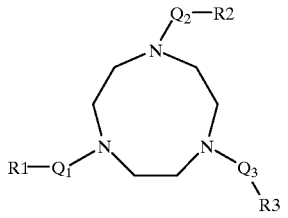

wherein R1, R2, R3 are as defined previously for $R_1$, $R_2$, $R_3$, and $Q_1$, $Q_2$, $Q_3$ are as defined previously.

Preferred classes of ligands according to this preferred aspect, as represented by formula (IID) above, are as follows:

(i) ligands of the general formula (IID) wherein:

R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) ligands of the general formula (IID) wherein:

two of R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and one of R1, R2, R3 represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl)

In this class, we prefer that:

two of R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and one of R1, R2, R3 represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

In especially preferred embodiments, the ligand is selected from:

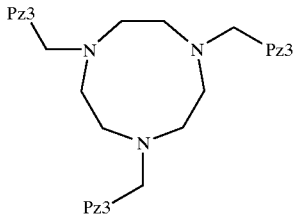

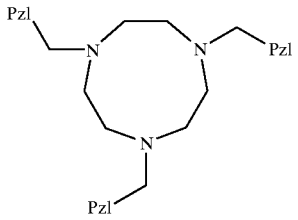

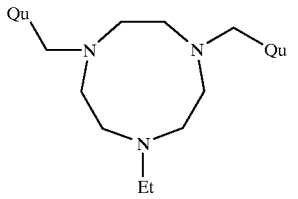

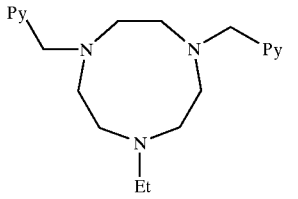

-continued

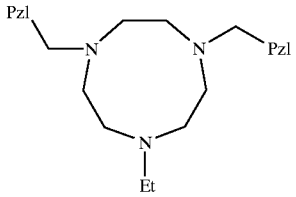

wherein —Et represents ethyl, —Py represents pyridin-2-yl, Pz3 represents pyrazol-3-yl, Pz1 represents pyrazol-1-yl, and Qu represents quinolin-2-yl.

(E) Ligands of the general formula (IE):

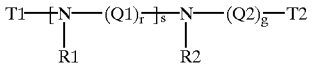

(IE)

wherein g represents zero or an integer from 1 to 6;

r represents an integer from 1 to 6;

s represents zero or an integer from 1 to 6;

Q1 and Q2 independently represent a group of the formula:

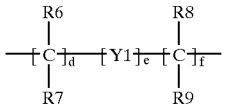

wherein $5 \geqq d+e+f \geqq 1$; d=0–5; e=0–5; f=0–5;

each Y1 independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

if s>1, each —[—N(R1)—$(Q1)_r$—]— group is independently defined;

R1, R2, R6, R7, R8, R9 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R6 together with R7, or R8 together with R9, or both, represent oxygen, or R6 together with R8 and/or independently R7 together with R9, or R6 together with R9 and/or independently R7 together with R8, represent $C_{1-6}$-alkylene optionally substituted by $C_{1-4}$-alkyl, —F, —Cl, —Br or —I;

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent ═CH—R10, wherein R10 is as defined for R1–R9, or T1 and T2 may together (—T2—T1—) represent a covalent bond linkage when s>1 and g>0;

if T1 and T2 together represent a single bond linkage, Q1 and/or Q2 may independently represent a group of the formula: ═CH—[—Y1—]$_e$—CH═ provided R1 and/or R2 are absent, and R1 and/or R2 may be absent provided Q1 and/or Q2 independently represent a group of the formula: ═CH—[—Y1—]$_e$—CH═.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts thereof, sulphamoyl-$C_0$–$C_{20}$-alkyl, amino-$C_0$-$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group is independently defined according to the formula for Q1, Q2, preferably being alkylene or hydroxy-alkylene or a heteroaryl-containing bridge, more preferably $C_{1-6}$-alkylene optionally substituted by $C_{1-4}$-alkyl, —F, —Cl, —Br or —I.

In a first variant according to formula (IE), the groups T1 and T2 together form a single bond linkage and s>1, according to general formula (IIE):

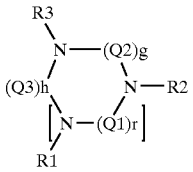

(IIE)

wherein R3 independently represents a group as defined for R1–R9; Q3 independently represents a group as defined for Q1, Q2; h represents zero or an integer from 1 to 6; and s=s−1.

In a first embodiment of the first variant, in general formula (IIE), s=1, 2 or 3; r=g=h=1; d=2 or 3; e=f=0; R6=R7=H, preferably such that the ligand has a general formula selected from:

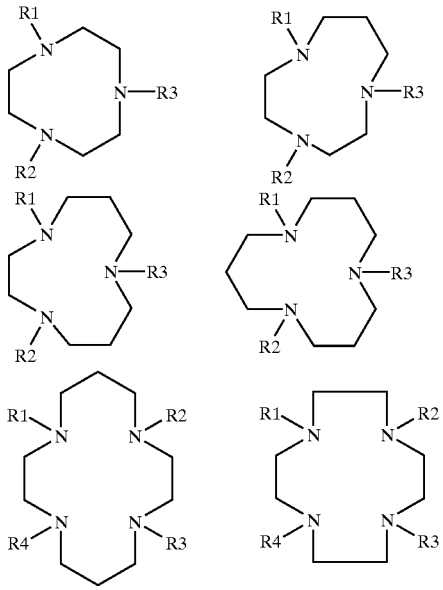

-continued

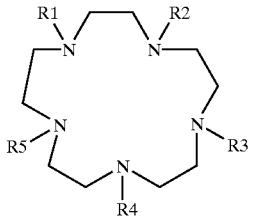

In these preferred examples, R1, R2, R3 and R4 are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

In a second embodiment of the first variant, in general formula (IIE), s=2 and r=g=h=1, according to the general formula:

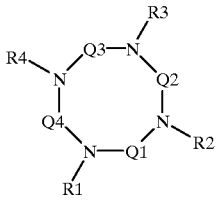

In this second embodiment, preferably R1–R4 are absent; both Q1 and Q3 represent $=CH—[—Y1—]_e—CH=$; and both Q2 and Q4 represent $—CH_2—[Y1—]_n—CH_2—$.

Thus, preferably the ligand has the general formula:

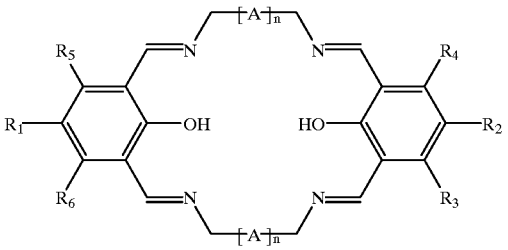

wherein A represents optionally substituted alkylene optionally interrupted by a heteroatom; and n is zero or an integer from 1 to 5.

Preferably, R1–R6 represent hydrogen, n=1 and $A=—CH_2—$, —CHOH—, $—CH_2N(R)CH_2—$ or $—CH_2CH_2N(R)CH_2CH_2—$ wherein R represents hydrogen or alkyl, more preferably $A=—CH_2—$, —CHOH— or $—CH_2CH_2NHCH_2CH_2—$.

In a second variant according to formula (IE), T1 and T2 independently represent groups R4, R5 as defined for R1–R9, according to the general formula (IIIE):

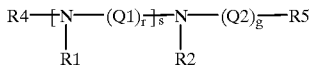

(IIIE)

In a first embodiment of the second variant, in general formula (IIIE), s=1; r=1; g=0; d=f=1; e=0–4; $Y1=—CH_2—$; and R1 together with R4, and/or R2 together with R5, independently represent =CH—R10, wherein R10 is as defined for R1–R9. In one example, R2 together with R5 represents =CH—R10, with R1 and R4 being two separate groups. Alternatively, both R1 together with R4, and R2 together with R5 may independently represent =CH—R10. Thus, preferred ligands may for example have a structure selected from:

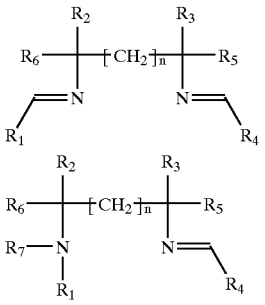

wherein n=0–4.

Preferably, the ligand is selected from:

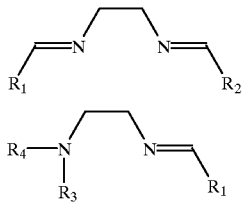

wherein R1 and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

In a second embodiment of the second variant, in general formula (IIIE), s=1; r=1; g=0; d=f=1; e=1–4; Y1=—C(R')(R"), wherein R' and R" are independently as defined for R1–R9. Preferably, the ligand has the general formula:

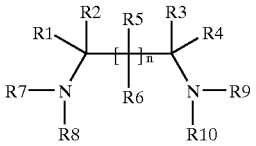

The groups R1, R2, R3, R4, R5 in this formula are preferably —H or $C_0$–$C_{20}$-alkyl, n=0 or 1, R6 is —H, alkyl, —OH or —SH, and R7, R8, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

In a third embodiment of the second variant, in general formula (IIIE), s=0; g=1; d=e=0; f=1–4. Preferably, the ligand has the general formula:

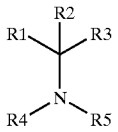

This class of ligand is particularly preferred according to the invention.

More preferably, the ligand has the general formula:

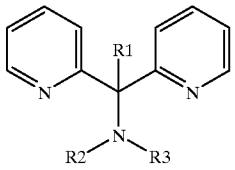

wherein R1, R2, R3 are as defined for R2, R4, R5.

In a fourth embodiment of the second variant, the ligand is a pentadentate ligand of the general formula (IVE):

(IVE)

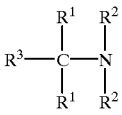

wherein each $R^1$, $R^2$ independently represents —$R^4$—$R^5$, $R^3$ represents hydrogen, optionally substituted alkyl, aryl or arylalkyl, or —$R^4$—$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

Ligands of the class represented by general formula (IVE) are also particularly preferred according to the invention. The ligand having the general formula (IVE), as defined above, is a pentadentate ligand. By 'pentadentate' herein is meant that five hetero atoms can coordinate to the metal M ion in the metal-complex.

In formula (IVE), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand of formula (IVE) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group. Preferably, the heteroaryl group is linked to methylamine, and preferably to the N atom thereof, via a methylene group. Preferably, the ligand of formula (IVE) contains at least one optionally substituted amino-alkyl side group, more preferably two amino-ethyl side groups, in particular 2-(N-alkyl) amino-ethyl or 2-(N,N-dialkyl) amino-ethyl.

Thus, in formula (IVE) preferably $R^1$ represents pyridin-2-yl or $R^2$ represents pyridin-2-yl-methyl. Preferably $R^2$ or $R^1$ represents 2-amino-ethyl, 2-(N-(m)ethyl)amino-ethyl or 2-(N,N-di(m)ethyl)amino-ethyl. If substituted, $R^5$ preferably represents 3-methyl pyridin-2-yl. $R^3$ preferably represents hydrogen, benzyl or methyl.

Examples of preferred ligands of formula (IVE) in their simplest forms are:

(i) pyridin-2-yl containing ligands such as:

N,N-bis(pyridin-2-yl-methyl)-bis(pyridin-2-yl) methylamine;

N,N-bis(pyrazol-1-yl-methyl)-bis(pyridin-2-yl) methylamine;

N,N-bis(imidazol-2-yl-methyl)-bis(pyridin-2-yl) methylamine;

N,N-bis(1,2,4-triazol-1-yl-methyl)-bis(pyridin-2-yl) methylamine;

N,N-bis(pyridin-2-yl-methyl)-bis(pyrazol-1-yl) methylamine;

N,N-bis(pyridin-2-yl-methyl)-bis(imidazol-2-yl) methylamine;

N,N-bis(pyridin-2-yl-methyl)-bis(1,2,4-triazol-1-yl) methylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-1-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-amino-ethyl containing ligands such as:

N,N-bis(2-(N-alkyl)amino-ethyl)-bis(pyridin-2-yl) methylamine;

N,N-bis(2-(N-alkyl)amino-ethyl)-bis(pyrazol-1-yl) methylamine;

N,N-bis(2-(N-alkyl)amino-ethyl)-bis(imidazol-2-yl) methylamine;

N,N-bis(2-(N-alkyl)amino-ethyl)-bis(1,2,4-triazol-1-yl) methylamine;

N,N-bis(2-(N,N-dialkyl)amino-ethyl)-bis(pyridin-2-yl) methylamine;

N,N-bis(2-(N,N-dialkyl)amino-ethyl)-bis(pyrazol-1-yl) methylamine;

N,N-bis(2-(N,N-dialkyl)amino-ethyl)-bis(imidazol-2-yl) methylamine;

N,N-bis(2-(N,N-dialkyl)amino-ethyl)-bis(1,2,4-triazol-1-yl) methylamine;

N,N-bis(pyridin-2-yl-methyl)-bis(2-amino-ethyl) methylamine;

N,N-bis(pyrazol-1-yl-methyl)-bis(2-amino-ethyl) methylamine;

N,N-bis(imidazol-2-yl-methyl)-bis(2-amino-ethyl) methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl) methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In a fifth embodiment of the second variant, the ligand represents a pentadentate or hexadentate ligand of general formula (VE):

$$R^1R^1N—W—NR^1R^2 \quad (VE)$$

wherein each $R^3$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand having the general formula (VE), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (VE), two hetero atoms are linked by the bridging group W and one coordinating hetero atom is contained in each of the three $R^1$ groups. Preferably, the coordinating hetero atoms are nitrogen atoms.

The ligand of formula (VE) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (VE), preferably via an alkylene group, more preferably a methylene group. Most preferably, the heteroaryl group is a 3-methyl-pyridin-2-yl group linked to an N atom via methylene.

The group $R^2$ in formula (VE) is a substituted or unsubstituted alkyl, aryl or arylalkyl group, or a group $R^1$. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$— (wherein —$C_6H_4$—, —$C_6H_{10}$—, —$C_{10}H_6$— can be ortho-, para-, or meta-$C_6H_4$—, —$C_6H_{10}$—, —$C_{10}H_6$—). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methyl pyridin-2-yl.

(F) Ligands of the classes disclosed in WO-A-98/39098 and WO-A-98/39406.

(H) Ligand having the formula (HI):

(HI)

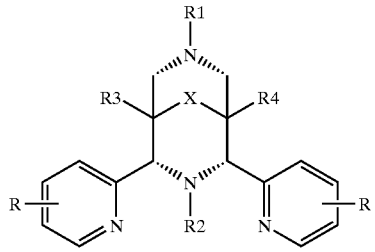

wherein each R is independently selected from: hydrogen, hydroxyl, —NH—CO—H, —NH—CO—C1–C4-alkyl, —$NH_2$, —NH—C1–C4-alkyl, and C1–C4-alkyl;

R1 and R2 are independently selected from:

C1–C4-alkyl,

C6–C10-aryl, and, a group containing a heteroatom capable of coordinating to a transition metal, preferably wherein at least one of R1 and R2 is the group containing the heteroatom;

R3 and R4 are independently selected from hydrogen, C1–C8 alkyl, C1–C8-alkyl-O—C1–C8-alkyl, C1–C8-alkyl-O—C6–C10-aryl, C6–C10-aryl, C1–C8-hydroxyalkyl, and —$(CH_2)_nC(O)OR_5$ wherein R5 is C1–C4-alkyl, n is from 0 to 4, and mixtures thereof; and, X is selected from C═O, —[C(R6)$_2$]$_y$— wherein Y is from 0 to 3 each R6 is independently selected from hydrogen, hydroxyl, C1–C4-alkoxy and C1–C4-alkyl.

(I) A further class of ligands is the macropolycyclic rigid ligand of formula (I) having denticity of 3 or 4:

(I)

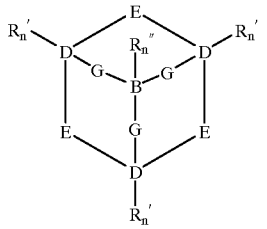

(ii) the macropolycyclic rigid ligand of formula (II) having denticity of 4 or 5

(II)

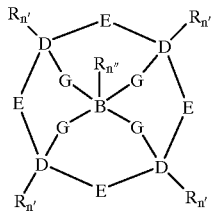

(iii) the macropolycyclic rigid ligand of formula (III) having denticity of 5 or 6:

(III)

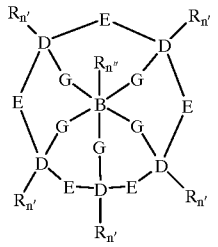

(iv) the macropolycyclic rigid ligand of formula (IV) having denticity of 6 or 7

(IV)

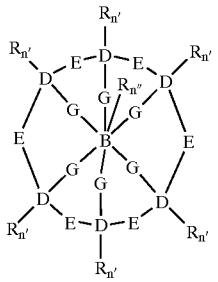

wherein in these formulas:

each "E" is the moiety $(CR_n)_a$—X—$(CR_n)_{a'}$, wherein X is selected from the group consisting of O, S, NR and P, or a covalent bond, and preferably X is a covalent bond and for each E the sum of a+a' is independently selected from 1 to 5, more preferably 2 and 3.

each "G" is the moiety $(CR_n)_b$.

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring.

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment).

"B" is a carbon atom or "D" donor atom, or a cycloalkyl or heterocyclic ring.

each "n" is an integer independently selected from 1 and 2, completing the valence of the carbon atoms to which the R moieties are covalently bonded.

each "n'" is an integer independently selected from 0 and 1, completing the valence of the D donor atoms to which the R moieties are covalently bonded.

each "n''" is an integer independently selected from 0,1, and 2 completing the valence of the B atoms to which the R moieties are covalently bonded.

each "a" and "a'" is an integer independently selected from 0–5, preferably a+a' equals 2 or 3, wherein the sum of all "a" plus "a'" in the ligand of formula (I) is within the range of from about 7 to about 11. The sum of all "a" plus "a" in the ligand of formula (II) is within the range of from about 6 (preferably 8) to about 12. The sum of all "a" plus "a'" in the ligand of formula (III) is within the range of from about 8 (preferably 10) to about 15, and the sum of all "a" plus "a'" in the ligand of formula (IV) is within the range of from about 10 (preferably 12) to about 18.

each "b" is an integer independently selected from 0–9, preferably 0–5 (wherein when b=0, $(CR_n)_0$ represents a covalent bond), or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5.

A preferred sub-group of the transition-metal complexes includes the Mn(II), Fe(II) and Cu(II) complexes of the ligand 1.2:

1.2

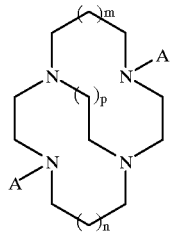

wherein m and n are integers from 0 to 2, p is an integer from 1 to 6, preferably m and n are both 0 or both 1 (preferably both 1), or m is 0 and n is at least 1; and p is 1;

and A is a nonhydrogen moiety preferably having no aromatic content; more particularly each A can vary independently and is preferably selected from methyl, ethyl, propyl, isopropyl, butyl, isobutyl, tert-butyl, C5–C20 alkyl, and one, but not both, of the A moieties is benzyl, and combinations thereof. In one such complex, one A is methyl and one A is benzyl.

Dichloro-5,12-dimethy-1,5,8,12-tetraazabicyclo[6.6.2] hexadecane Manganese(II)

Dichloro-4,10-dimethyl-1,4,7,10-tetraazabicyclo[5.5.2] tetradecane Manganese(II)

Diaquo-5,12-dimethyl-1,5,8,12-tetraazabicyclo[6.6.2] hexadecane Manganese (II) Hexafluorophosphate Aquo-hydroxy-5,12-dimethyl-1,5,8,12-tetraazabicyclo [6.6.2]hexadecane Manganese(III) Hexafluorophosphate Diaquo-4,10-dimethyl-1,4,7,10-tetraazabicyclo[5.5.2] tetradecane Manganese(II) Hexafluorophosphate Diaquo-5,12-dimethyl-1,5,8,12-tetraazabicyclo[6.6.2] hexadecane Manganese(II) Tetrafluoroborate Diaquo-4,10-dimethyl-1,4,7,10-tetraazabicyclo[5.5.2] tetradecane Manganese(II) Tetrafluoroborate Dichloro-5,12-dimethyl-1,5,8,12-tetraazabicyclo[6.6.2] hexadecane Manganese(III) Hexafluorophosphate Dichloro-5,12-di-n-butyl-1,5,8,12-tetraazabicyclo[6.6.2] hexadecane Manganese(II)

Dichloro-5, I 2-dibenzyl-1,5,8, I 2-tetraazabicyclo[6.6.2] hexadecane Manganese(II)

Dichloro-5-n-butyl-12-methyl-1,5,8,12-tetraazabicyclo [6.6.2]hexadecane Manganese(II)

Dichloro-5-n-octyl-12-methyl-I5,8, I 2-tetraaza-bicyclo [6.6.2]hexadecane Manganese(II) Dichloro-5-n-butyl-12-methyl-I,5,8,12-tetraaza-bicyclo[6.6.2]hexadecane Manganese (II)

Dichloro-5,12-dimethyl-1,5,8,12-tetraazabicyclo[6.6.2] hexadecane Iron(II)

Dichloro-4,10-dimethyl-1,4,7,10-tetraazabicyclo[5.5.2] tetradecane Iron(II)

Dichloro-5,12-dimethyl-1,5,8,12-tetraazabicyclo[6.6.2] hexadecane Copper(II)

Dichloro-4,10-dimethyl-1,4,7,10-tetraazabicyclo[5.5.2] tetradecane Copper(II)

Dichloro-5,12-dimethyl-1,5,8,12-tetraazabicyclo[6.6.2] hexadecane Cobalt(II)

Dichloro-4,10-dimethyl-1,4,7,10-tetraazabicyclo[5.5.2] tetradecane Cobalt(II)

Dichloro 5,12-dimethyl-4-phenyl-1,5,8,12-tetraazabicyclo [6.6.2]hexadecane Manganese(II)

Dichloro-4,10-dimethyl-3-phenyl-1,4,7,10-tetraazabicyclo [5.5.2]tetradecane Manganese(II)

Dichloro-5,12-dimethyl-4,9-diphenyl-1,5,8,12-tetraazabicyclo[6.6.2]hexadecane Manganese(II)

Dichloro-4,10-dimethyl-3,8-diphenyl-1,4,7,10-tetraazabicyclo[5.5.2]tetradecane Manganese(II)

Dichloro-5,12-dimethyl-2,11-diphenyl-1,5,8,12-tetraazabicyclo[6.6.2]hexadecane Manganese(II)

Dichloro-4,10-dimethyl-4,9-diphenyl-1,4,7,10-tetraazabicyclo[5.5.2]tetradecane Manganese(II)

Dichloro-2,4,5,9,11,12-hexamethyl-1,5,8,12-tetraazabicyclo[6.6.2]hexadecane Manganese(II)

Dichloro-2,3,5,9,10,12-hexamethyl-1,5,8,12-tetraazabicyclo[6.6.2]hexadecane Manganese(II)

Dichloro-2,2,4,5,9,9,11,12-octamethyl-1,5,8,12-tetraazabicyclo[6.6.2]hexadecane Manganese(II)

Dichloro-2,2,4,5,9,11,11,12-octamethyl-1,5,8,12-tetraazabicyclo[6.6.2]hexadecane Manganese(II)

Dichloro-3,3,5,10,10,12-hexamethyl-1,5,8,12-tetraazabicyclo[6.6.2]hexadecane Manganese(II)

Dichloro-3,5,10,12-tetramethyl-1,5,8,12-tetraazabicyclo [6.6.2]hexadecane Manganese(II)

Dichloro-3-butyl-5,10,12-trimethyl-1,5,8,12-tetraazabicyclo[6.6.2]hexadecane Manganese(II)

Dichloro-1,5,8,12-tetraazabicyclo[6.6.2]hexadecane Manganese(II)

Dichloro-1,4,7,10-tetraazabicyclo[5.5.2]tetradecane Manganese(II)

Dichloro-1,5,8,12-tetraazabicyclo[6.6.2]hexadecane Iron (II)

Dichloro-1,4,7,10-tetraazabicyclo[5.5.2]tetradecane Iron(II)

Aquo-chloro-2-(2-hydroxyphenyl)-5,12-dimethyl,5,8,12-tetraazabicyclo[6.6.2]hexadecane Manganese(II)

Aquo-chloro-10-(2-hydroxybenzyl)-4,10-dimethyl-1,4,7,10-tetraazabicyclo[5.5.2]tetradecane Manganese(II)

Chloro-2-(2-hydroxybenzyl)-5-methy 1,5,8,12-tetraazabicyclo[6.6.2]hexadecane Manganese(II)

Chloro-10-(2-hydroxybenzyl)-4-methyl-1,4,7,10-tetraazabicyclo[5.5.2]tetradecane Manganese(II)

Chloro-5-methyl-12-(2-picolyl)-1,5,8,12-tetraazabicyclo [6.6.2]hexadecane Manganese(II) Chloride Chloro-4-methyl-10-(2-picolyl)-1,4,7,10-tetraazabicyclo [5.5.2]tetradecane Manganese(II) Chloride Dichloro-5-(2-sulphato)dodecyl-12-methyl-I,5,8,12-tetraazabicyclo[6.6.2]hexadecane Manganese(III)

Aquo-Chloro-5-(2-sulphato)dodecyl-12-methyl-1,5,8,12-tetraazabicyclo[6.6.2]hexadecane Manganese(II)

Aquo-Chloro-5-(3-sulphonopropyl)-12-methyl-1,5,8,12-tetraazabicyclo[6.6.2]hexadecane Manganese(II)

Dichloro-5-(Trimethylammoniopropyl)dodecyl-12-methyl-1,5,8,12-tetraazabicyclo[6.6.2]hexadecane Manganese (III)

Chloride

Dichloro-5,12-dimethyl-1,4,7,10,13-pentaazabicyclo[8.5.2] heptadecane Manganese(II)

Dichloro-14,20-dimethyl-1,10,14,20-tetraazatriyclo[8.6.6] docosa-3(8),4,6-triene Manganese(II)

Dichloro-4.11-dimethyl-1,4,7,11-tetraazabicyclo[6.5.2] pentadecane Manganese(II)

Dichloro-5,12-dimethyl-1,5,8,12-tetraazabicyclo[7.6.2] heptadecane Manganese(II)

Dichloro-5.13-dimethyl-1,5,9,13-tetraazabicyclo[7.7.2] heptadecane Manganese(II)

Dichloro-3,10-bis(butylcarboxy)-5,12-dimethyl-1,5,8,12-tetraazabicyclo[6.6.2]hexadecane Manganese(II)

Diaquo-3,10-dicarboxy-5,12-dimethyl-1,5,8,12-tetraazabicyclo[6.6.2]hexadecane Manganese(II)

Chloro-20-methyl-1,9,20,24,25-pentaaza-tetracyclo [7.7.7.1$^{3,7}$.1$^{11,15}$]pentacosa-3,5,7(24),11,1315(25)-hexaene manganese(II) Hexafluorophosphate Trifluoromethanesulphono-20-methyl-1,9,20,24,25-pentaaza-tetracyclo[7.7.7.1$^{3,7}$.1$^{11,15}$]pentacosa -3,5,7 (24),11,13,15(25)-hexaene Manganese(II) trifluoromethanesulphonate Trifluoromethanesulphono-20-methyl-1,9,20,24,25-pentaaza-tetracyclo[7.7.7.1$^{3,7}$.1$^{11,15}$.]pentacosa -3,5,7 (24),11,13,15(25)-hexaene Iron(II) trifluoromethanesulphonate Chloro-5,12,17-trimethyl-1,5,8,12,17-pentaazabicyclo [6.6.5]nonadecane Manganese(II) hexafluorophosphate Chloro-4,10,15-trimethyl-1,4,7,10,15-pentaazabicyclo [5.5.5]heptadecane Manganese(II) hexafluorophosphate Chloro-5,12,17-trimethyl-1,5,8,12,17-pentaazabicyclo [6.6.5]nonadecane Manganese(II) chloride Chloro-4,10,15-trimethyl-1,4,7,10,15-pentaazabicyclo [5.5.5]heptadecane Manganese(II) chloride The invention further includes the compositions which include the transition-metal complexes, preferably the Mn, Fe, Cu and Co complexes, or preferred cross-bridged macropolycyclic ligands having the formula:

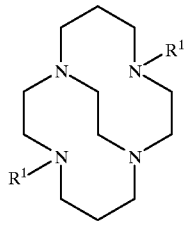

wherein in this formula "R1" is independently selected from H, and linear or branched, substituted or unsubstituted C1–C20 alkyl, alkylaryl, alkenyl or alkynyl, more preferably RI is alkyl or alkylaryl; and preferably all nitrogen atoms in the macropolycyclic rings are coordinated with the transition metal.

Also preferred are cross-bridged macropolycyclic ligands having the formula:

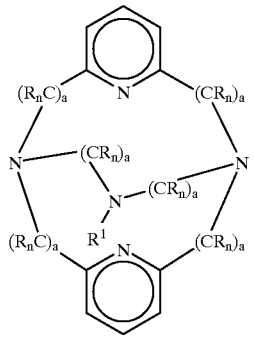

wherein in this formula:

each "n" is an integer independently selected from 1 and 2, completing the valence of the carbon atom to which the R moieties are covalently bonded;

each "R" and "R1" is independently selected from H, alkyl, alkenyl, alkynyl, aryl, alkylaryl (e.g., benzyl), and heteroaryl, or R and/or R1 are covalently bonded to form an aromatic, heteroaromatic, cycloalkyl, or heterocycloalkyl ring, and wherein preferably all R are H and R1 are independently selected from linear or branched, substituted or unsubstituted C1–C20 alkyl, alkenyl or alkynyl;

each "a" is an integer independently selected from 2 or 3;

preferably all nitrogen atoms in the macropolycyclic rings are coordinated with the transition metal. In terms of the present invention, even though any of such ligands are known, the invention encompasses the use of these ligands in the form of their transition-metal complexes as oxidation catalysts, or in the form of the defined catalytic systems.

In like manner, included in the definition of the preferred cross-bridged macropolycyclic ligands are those having the formula:

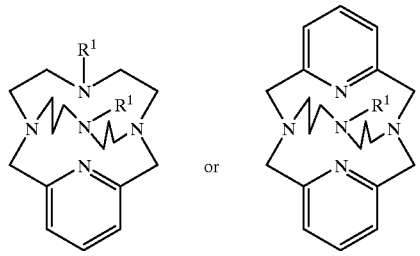

wherein in either of these formulae, "$R^1$" is independently selected from H, or, preferably, linear or branched, substituted or unsubstituted C1–C20 alkyl, alkenyl or alkynyl; and preferably all nitrogen atoms in the macropolycyclic rings are coordinated with the transition metal.

The present invention has numerous variations and alternate embodiments. Thus, in the foregoing catalytic systems, the macropolycyclic ligand can be replaced by any of the following:

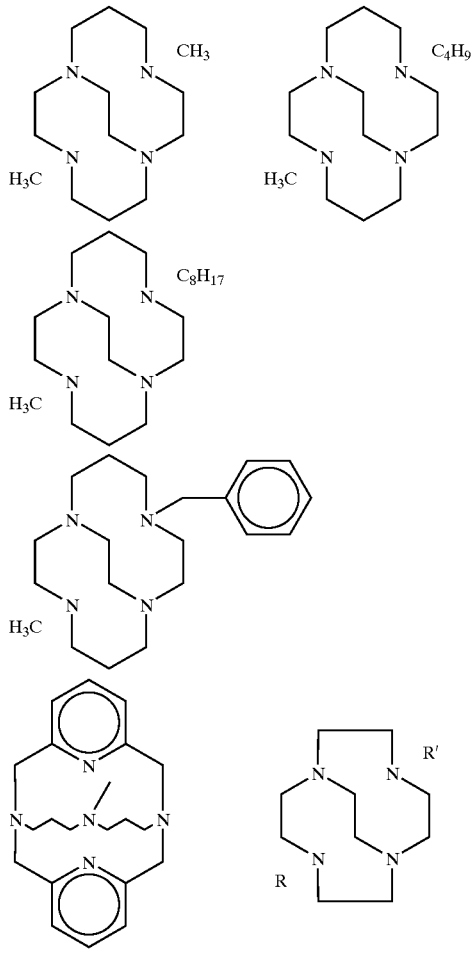

-continued

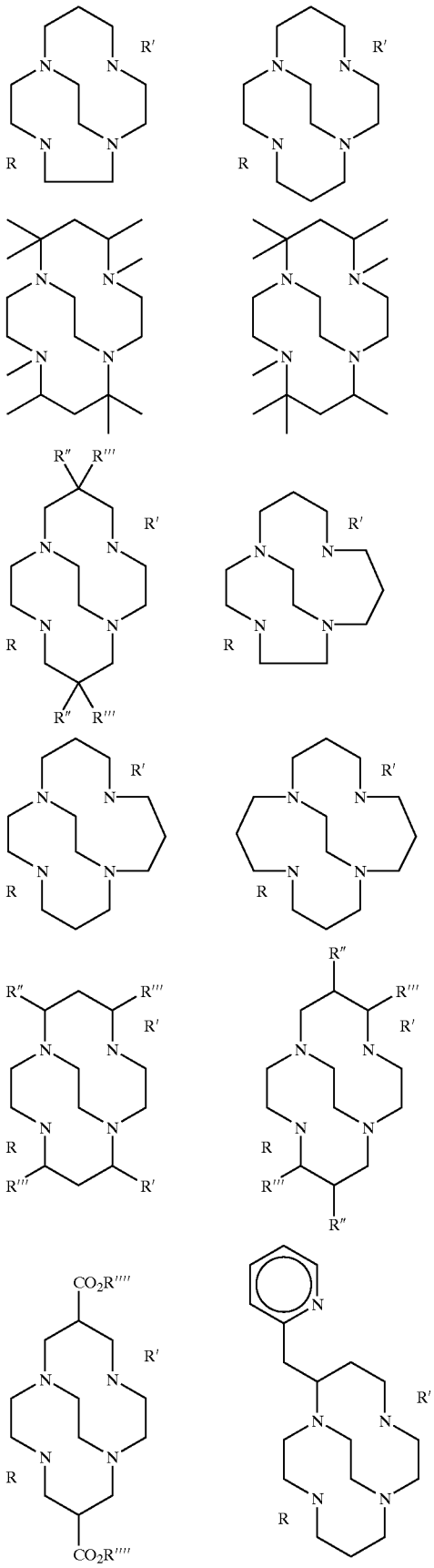

-continued

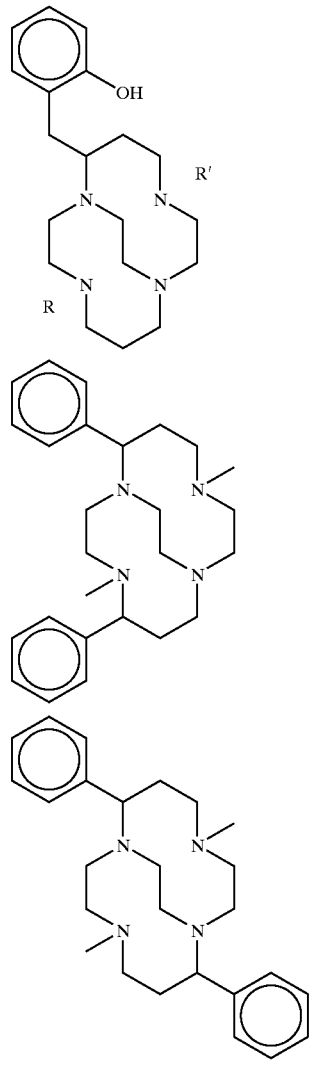

In the above, the R, R', R", R'" moieties can, for example, be methyl, ethyl or propyl. (Note that in the above formalism, the short straight strokes attached to certain N atoms are an alternate representation for a methyl group).

While the above illustrative structures involve tetra-aza derivatives (four donor nitrogen atoms), ligands and the corresponding complexes in accordance with the present invention can also be made, for example from any of the following:

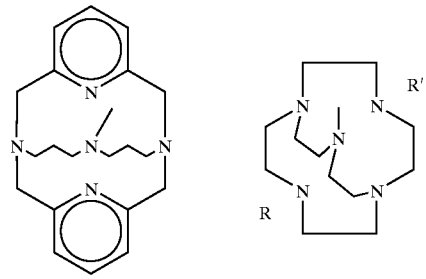

-continued

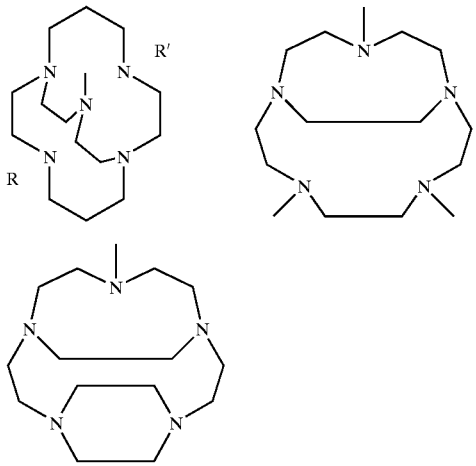

Moreover, using only a single organic macropolycycle, preferably a cross-bridged derivative of cyclam, a wide range of oxidation catalyst compounds of the invention may be prepared; numerous of these are believed to be novel chemical compounds. Preferred transition-metal catalysts of both cyclam-derived and non-cyclam-derived cross-bridged kinds are illustrated, but not limited, by the following:

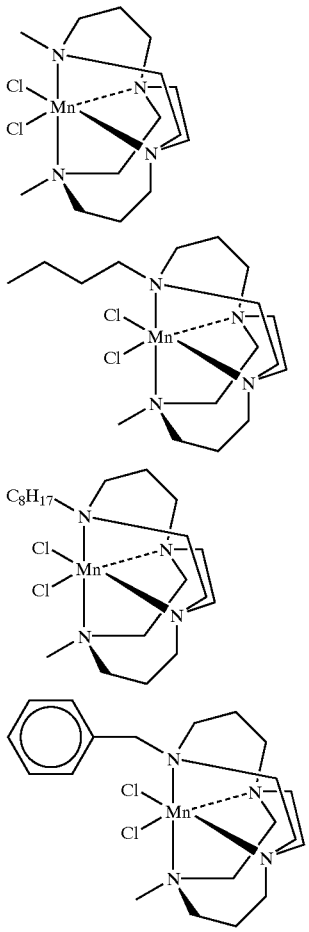

-continued

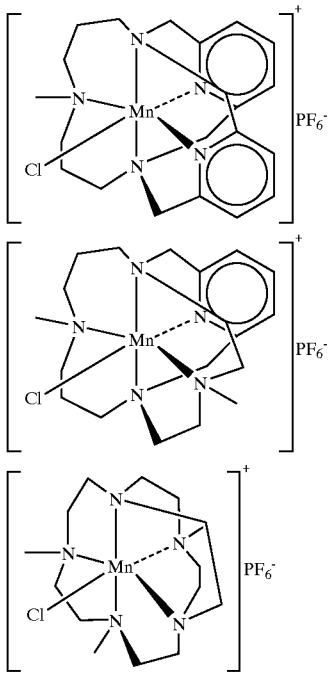

In other embodiments of the invention, transition-metal complexes, such as the Mn, Fe, Co, or Cu complexes, especially (II) and/or (III) oxidation state complexes, of the hereinabove-identified metals with any of the following ligands are also included:

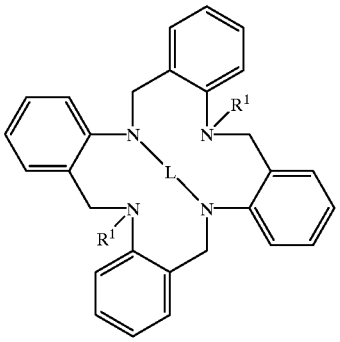

wherein R1 is independently selected from H (preferably non-H) and linear or branched, substituted or unsubstituted C1–C20 alkyl, alkenyl or alkynyl and L is any of the linking moieties given herein, for example 1.10 or 1.11;

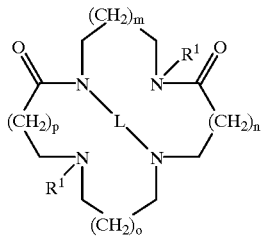

wherein R1 is as defined supra; m,n,o and p can vary independently and are integers which can be zero or a positive integer and can vary independently while respecting the provision that the sum m+n+o+p is from 0 to 8 and L is any of the linking moieties defined herein;

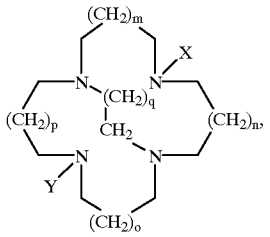

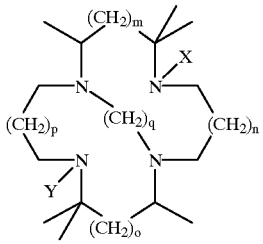

or

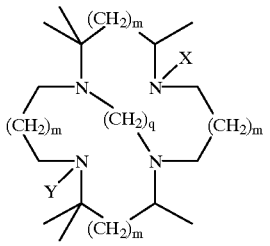

wherein X and Y can be any of the R1 defined supra, m,n,o and p are as defined supra and q is an integer, preferably from 1 to 4; or, more generally,

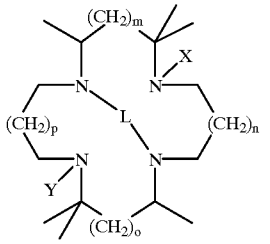

wherein L is any of the linking moieties herein, X and Y can be any of the RI defined supra, and m,n,o and p are as defined supra. Alternately, another useful ligand is:

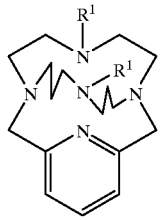

wherein RI is any of the RI moieties defined supra.

Pendant Moieties

Macropolycyclic rigid ligands and the corresponding transition-metal complexes and oxidation catalytic systems herein may also incorporate one or more pendant moieties, in addition to, or as a replacement for, R1 moieties. Such pendant moieties are nonlimitingly illustrated by any of the following:

$$-(CH_2)_n-CH_3 \quad -(CH_2)_n-C(O)NH_2 \quad -(CH_2)_n-CN$$
$$-(CH_2)_n-C(O)OH \quad -(CH_2)_n-C(O)NR_2$$
$$-(CH_2)_n-OH \quad -(CH_2)_n-C(O)OR$$

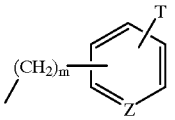

The counter ions Y in formula (Al) balance the charge z on the complex formed by the ligand L, metal M and coordinating species X. Thus, if the charge z is positive, Y may be an anion such as $RCOO^-$, $BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF_6^-$, $RSO_3^-$ (in particular $CF_3SO_3^-$), $RSO_4^-$, $SO_4^{2-}$, $NO_3^-$, $F^-$, $Cl^-$, $Br^-$, and $I^-$, wherein R represents hydrogen or optionally substituted phenyl, naphthyl or $C_1$–$C_4$ alkyl.

Throughout the description and claims generic groups have been used, for example alkyl, alkoxy, aryl. Unless otherwise specified the following are preferred group restrictions that may be applied to generic groups found within compounds disclosed herein:

alkyl: C1–C6-alkyl, alkenyl: C2–C6-alkenyl, cycloalkyl: C3–C8-cycloalkyl, alkoxy: C1–C6-alkoxy, alkylene: selected from the group consisting of: methylene; 1,1-ethylene; 1,2-ethylene; 1,1-propylene; 1,2-propylene; 1,3-propylene; 2,2-propylene; butan-2-ol-1,4-diyl; propan-2-ol-1,3-diyl; and 1,4-butylene, aryl: selected from homoaromatic compounds having a molecular weight under 300, arylene: selected from the group consisting of: 1,2-benzene; 1,3-benzene; 1,4-benzene; 1,2-naphthalene; 1,3-naphthalene; 1,4-naphthalene; 2,3-naphthalene; phenol-2,3-diyl; phenol-2,4-diyl; phenol-2,5-diyl; and phenol-2,-6-diyl, heteroaryl: selected from the group consisting of: pyridinyl; pyrimidinyl; pyrazinyl; triazolyl, pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, heteroarylene: selected from the group consisting of: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, heterocycloalkyl: selected from the group consisting of: pyrrolinyl; pyrrolidinyl; morpholinyl; piperidinyl; piperazinyl; hexamethylene imine; and oxazolidinyl, amine: the group $—N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulphonate: the group —$S(Q)_2OR$, wherein R is selected from: hydrogen; C1–C6-alkyl; phenyl; C1–C6-alkyl-C6H5; Li; Na; K; Cs; Mg; and Ca, sulphate: the group —$OS(O)_2OR$, wherein R is selected from: hydrogen; C1–C6-alkyl; phenyl; C1–C6-alkyl-C6H5; Li; Na; K; Cs; Mg; and Ca, sulphone: the group —S(O)2R, wherein R is selected from: hydrogen; C1–C6-alkyl; phenyl; C1–C6-alkyl-C6H5 and amine (to give sulphonamide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, carboxylate derivative: the group —C(O)OR, wherein R is selected from: hydrogen, C1–C6-alkyl; phenyl; C1–C6-alkyl-C6H5, Li; Na; K; Cs; Mg; and Ca, carbonyl derivative: the group —C(O)R, wherein R is selected from: hydrogen; C1–C6-alkyl; phenyl; C1–C6-alkyl-C6H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —$P(O)(OR)_2$, wherein each R is independently selected from: hydrogen; C1–C6-alkyl; phenyl; C1–C6-alkyl-C6H5; Li; Na; K; Cs; Mg; and Ca, phosphate: the group —$OP(O)(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

alkyl: C1–C4-alkyl, alkenyl: C3–C6-alkenyl, cycloalkyl: C6–C8-cycloalkyl, alkoxy: C1–C4-alkoxy, alkylene: selected from the group consisting of: methylene; 1,2-ethylene; 1,3-propylene; butan-2-ol-1,4-diyl; and 1,4-butylene, aryl: selected from group consisting of: phenyl; biphenyl, naphthalenyl; anthracenyl; and phenanthrenyl, arylene: selected from the group consisting of: 1,2-benzene, 1,3-benzene, 1,4-benzene, 1,2-naphthalene, 1,4-naphthalene, 2,3-naphthalene and phenol-2,6-diyl, heteroaryl: selected from the group consisting of: pyridinyl; pyrimidinyl; quinolinyl; pyrazolyl; triazolyl; isoquinolinyl; imidazolyl; and oxazolidinyl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; and piperazinyl, amine: the group —$N(R)_2$, wherein each R is independently selected from: hydrogen; C1–C6-alkyl; and benzyl, halogen: selected from the group consisting of: F and Cl, sulphonate: the group —$S(O)_2OR$, wherein R is selected from: hydrogen; C1–C6-alkyl; Na; K; Mg; and Ca, sulphate: the group —$OS(O)_2OR$, wherein R is selected from: hydrogen; C1–C6-alkyl; Na; K; Mg; and Ca, sulphone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR'2, wherein each R' is independently selected from: hydrogen; C1–C6-alkyl; and benzyl, phosphonate: the group —$P(O)(OR)_2$, wherein each R is independently selected from: hydrogen; C1–C6-alkyl, benzyl; Na; K; Mg; and Ca, phosphate: the group —$OP(O)(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —P(O)R2, wherein R is independently selected from: hydrogen; C1–C6-alkyl; benzyl and amine selected from the group: —NR'2, wherein each R' is independently selected from: hydrogen; C1–C6-alkyl; and benzyl.

Use of Targeted Bleach Catalyst with Peroxyl Species or Precursor Thereof.

The targeted bleach catalysts of the present invention may be oxygen bleaching catalysts and/or peroxyl bleaching catalysts. Bleach catalysts that are predominately non-oxygen bleaching catalysts may be used with a peroxyl species or precursor thereof. Conversely, oxygen bleaching catalysts may be used with oxygen and/or a peroxyl species as precursor. The peroxy compound bleaches that may be utilised in the present invention include hydrogen peroxide, hydrogen peroxide-liberating compounds, hydrogen peroxide-generating systems, peroxy acids and their salts and peroxy acid bleach percursor system, monoperoxysulphate salts, peroxyphosphate salt and mixtures thereof. Hydrogen peroxide sources are well known in the art. They include alkali metal peroxides, organic peroxidase bleaching compounds such as urea peroxide, and inorganic persalt bleaching compounds, such as the alkali metal perborates, percarbonates, peroxyphosphates, and peroxysulphates. Mixtures of two or more of such compounds may also be suitable. Particularly preferred are sodium perborate or sodium percarbonate. These bleaching compounds may further be employed in conjunction with a peroxyacid bleaching precursor, for example tetraacetylethylenediamine (TAED) or sodium nonanoyloxybenzenesulphonate (SNOBS). The use of a peroxyacid bleaching precursor as detailed above for bleaching a substrate will likely reduce the presence of bacteria on washed laundry, improve bleaching performance and in the case of white fabric increase the overall whiteness appearance of the white fabric.

Peroxyacid bleaches and their precursors are known and amply described in literature. Suitable examples of this general class include magnesium monoperoxyphthalate hexahydrate (INTEROX), metachloro perbenzoic acid, 4-nonylamino-4oxoperoxybutyric acid and diperoxydodecanedioic acid, 6-nonylamino-6-oxoperoxycaproic acid (NAPAA), peroxybenzoic acid, ring-substituted peroxybenzoic acids, e.g., peroxy-o-naphthoic acid, peroxylauric acid, peroxystearic acid, 1,9-diperoxyazelaic acid, 1,12-diperoxydodecanedioic acid, diperoxybrassylic acid, diperoxysebacic acid, diperoxyisophthalic acid, 2-decyldiperoxybutane-1,4-dioic acid, 4,4'-sulfonybisperoxybenzoic acid, and N,N-phthaloylaminoperoxycaproic acid (PAP). nonanoyloxybenzenesulphonate (SNOBS). Other examples of peroxyacid bleaches and their precursors are described in Chemistry & Industry (Oct. 15, 1990), 647–653, an article by Grime and Clauss.

The range of peroxyl species present in a bleaching composition of the present invention is 4 to 20%, preferably 5 to 10, most preferably 6 to 8% wt/wt. Examples of preferred peroxyl species are sodium perborate and sodium percarbonate.

The Recognising Portion

The recognising portion has a high binding affinity for a stain present on a fabric. It is likely that one part of a polypeptide chain of an enzyme is responsible for the binding affinity. Examples of suitable recognising portions are found in EP 9803438 (Unilever). The exemplified and postulated recognising portions of EP9803438 are applicable to the present invention, herein incorporated by reference.

The targeted bleach catalyst having the high binding affinity may comprise a bleach catalyst covalently coupled to an enzyme part for binding to a stain, by means of a bi-valent coupling agent such as glutardialdehyde. Greg T. Hermanson, Academic Press Inc (1986), provides a full review of chemistries appropriate for coupling two biomolecules in "Bioconjugate techniques". Alternatively, if the reagent having the high binding affinity is a peptide or a protein, it may also be coupled to an enzyme bound to a bleaching catalyst by constructing a fusion protein. In such a construct there would typically be a peptide linker between the binding reagent and the enzyme. An example of a fusion of an enzyme and a binding reagent is described in Ducancel et al. Bio/technology 11, 601–605.

A further embodiment would be for the recognising portion with a high binding affinity to be a bispecific reagent, comprising a specificity for stain and a specificity for an enzyme bound to the bleach catalyst, or a specificity for the bleach catalyst per se. Such a recognising portion could fulfil the requirement of accumulating a bleaching catalyst on stain either by supplying the reagent together with enzyme bound to the bleach catalyst or bleach catalyst per se, preferably as a pre-formed non-covalent complex. Alternatively, the recognising portion is supplied separately with enzyme bound to the bleach catalyst or bleach catalyst per se and allowed to self-assemble either in the wash liquor or on the stain. It is also possible for the reagent with a high binding affinity to be a trispecific reagent. The trispecific reagent binding a bleach catalyst, a stain and an enzyme part capable of generating a bleaching chemical.

The optional bleaching enzyme according to the invention may be targeted to the stain. Alternatively the bleaching enzyme is not targeted/non-specific and remains substantially free in solution. Another alternative provided by the present invention would be to target the fabric rather that the stain per se. In this instance, the recognising portion with a high binding affinity may contain, for example, a cellulose binding domain (CBD). Examples of various CBD's that may be used with the present invention are found in co-owned application EP 99310428.0. In addition, further suitable CBD's may be found in U.S. Pat. No. 5,837,814, and WO9728243 and references found therein.

It is also within the scope of the invention that the enzyme comprises an enzyme part capable of generating a bleaching chemical, which is coupled to a reagent, having the high binding affinity for stains present on fabrics. The bleaching enzyme may be a fusion protein comprising two domains, which may be coupled by means of a linker.

The degree of binding of a compound A to another molecule B can be generally expressed by the chemical equilibrium constant $K_d$ resulting from the following binding reaction:

$$[A]+[B]=[AB]$$

The chemical equilibrium constant $K_d$ is then given by:

$$K_d = \frac{[A]\times[B]}{[AB]}$$

Whether the binding to the stains is specific or not can be judged from the difference between the binding ($K_d$ value) of the compound to stained (i.e. a material treated so that stain components are bound on), versus the binding to unstained (i.e. untreated) material, or versus the binding to material stained with an unrelated chromophore. For applications in laundry, said material will be a fabric such as cotton or polyester. However, it will usually be more convenient to measure $K_d$ values and differences in $K_d$ values on other materials such as a polystyrene microtitre plate or a specialised surface in an analytical biosensor. The difference between the two binding constants should be minimally 10, preferably more than 100, and more preferably, more that 1000. Typically, the compound should bind the stain, or the stained material, with a $K_d$ lower than $10^{-4}$ M, preferably lower than $10^{-6}$ M and could be $10^{-10}$ M or even less. Higher binding affinities ($K_d$ of less than $10^{-5}$ M) and/or a larger difference between coloured substance and background binding would increase the selectivity of the bleaching process. Also, the weight efficiency of the compound in the total detergent composition would be increased and smaller amounts of the compound would be required.

Several classes of compounds can be envisaged which deliver the capability of specific binding to stains one would like to bleach. In the following we will give a number of examples of such compounds having such capabilities, without pretending to be exhaustive.

Antibodies

Antibodies are well known examples of protein molecules, which are capable of binding specifically to compounds against which they were raised. Antibodies can be derived from several sources. From mice, monoclonal antibodies can be obtained which possess very high binding affinities. From such antibodies, Fab, Fv or scFv fragments, can be prepared which have retained their binding properties. Such antibodies or fragments can be produced through recombinant DNA technology by microbial fermentation. Well known production hosts for antibodies and their fragments are yeast, moulds or bacteria.

A class of antibodies of particular interest is formed by the Heavy Chain antibodies as found in Camelidae, like the camel or the llama. The binding domains of these antibodies consist of a single polypeptide fragment, namely the variable region of the heavy chain polypeptide (HC-V). In contrast, in the classic antibodies (murine, human, etc.), the binding domain consist of two polypeptide chains (the variable regions of the heavy chain ($V_h$) and the light chain ($V_l$)). Procedures to obtain heavy chain immunoglobulins from Camelidae, or (functionalized) fragments thereof, have been described in WO-A-94/04678 (Casterman and Hamers) and WO-A-94/25591 (Unilever and Free University of Brussels).

Alternatively, binding domains can be obtained from the $V_h$ fragments of classical antibodies by a procedure termed "camelization". Hereby the classical $V_h$ fragment is transformed, by substitution of a number of amino acids, into a HC-V-like fragment, whereby its binding properties are retained. This procedure has been described by Riechmann et al. in a number of publications (J. Mol. Biol. (1996) 259, 957–969; Protein. Eng. (1996) 9, 531–537, Bio/Technology (1995) 13, 475–479). Also HC-V fragments can be produced through recombinant DNA technology in a number of microbial hosts (bacterial, yeast, mould), as described in WO-A-94/29457 (Unilever).

Methods for producing fusion proteins that comprise an enzyme and an antibody or that comprise an enzyme and an antibody fragment are already known in the art. One approach is described by Neuberger and Rabbits (EP-A-194 276). A method for producing a fusion protein comprising an enzyme and an antibody fragment that was derived from an antibody originating in Camelidae is described in WO-A-94/25591. A method for producing bispecific antibody fragments is described by Holliger et al. (1993) PNAS 90, 6444–6448.

A particularly attractive feature of antibody binding behavior is their reported ability to bind to a "family" of structurally-related molecules. For example, in Gani et al. (J. Steroid Biochem. Molec. Biol. 48, 277–282) an antibody is described that was raised against progesterone but also binds to the structurally-related steroids, pregnanedione, pregnanolone and 6-hydroxy-progesterone. Therefore, using the same approach, antibodies could be isolated that bind to a whole "family" of stain chromophores (such as the polyphenols, porphyrins, or caretenoids as described below). A broad action antibody such as this could be used to treat several different stains when coupled to a bleach catalyst.

Peptides

Peptides usually have lower binding affinities to the substances of interest than antibodies. Nevertheless, the binding properties of carefully selected or designed peptides can be sufficient to deliver the desired selectivity in an oxidation process. A peptide which is capable of binding selectively to a substance which one would like to oxidise, can for instance be obtained from a protein which is known to bind to that specific substance. An example of such a peptide would be a binding region extracted from an antibody raised against that substance. Other examples are proline-rich peptides that are known to bind to the polyphenols in wine.

Alternatively, peptides which bind to such substance can be obtained by the use of peptide combinatorial libraries. Such a library may contain up to $10^{10}$ peptides, from which the peptide with the desired binding properties can be isolated. (R. A. Houghten, Trends in Genetics, Vol 9, no &, 235–239). Several embodiments have been described for this procedure (J. Scott et al., Science (1990) 249, 386–390; Fodor et al., Science (1991) 251, 767–773; K. Lam et al., Nature (1991) 354, 82–84; R. A. Houghten et al., Nature (1991) 354, 84–86).

Suitable peptides can be produced by organic synthesis, using for example the Merrifield procedure (Merrifield (1963) J.Am.Chem.Soc. 85, 2149–2154). Alternatively, the peptides can be produced by recombinant DNA technology in microbial hosts (yeast, moulds, bacteria) (K. N. Faber et al. (1996) Appl. Microbiol. Biotechnol. 45, 72–79).

Pepidomimics

In order to improve the stability and/or binding properties of a peptide, the molecule can be modified by the incorporation of non-natural amino acids and/or non-natural chemical linkages between the amino acids. Such molecules are called peptidomimics (H. U. Saragovi et al. (1991) Bio/Technology 10, 773–778; S. Chen et al. (1992) Proc. Natl. Acad. Sci. USA 89, 5872–5876). The production of such compounds is restricted to chemical synthesis.

Other Organic Molecules

It can be readily envisaged that other molecular structures, which need not be related to proteins, peptides or derivatives thereof, can be found which bind selectively to substances one would like to oxidise with the desired binding properties. For example, certain polymeric RNA molecules which have been shown to bind small synthetic dye molecules (A. Ellington et al. (1990) Nature 346, 818–822).

Such binding compounds can be obtained by the combinatorial approach, as described for peptides (L. B. McGown et al. (1995), Analytical Chemistry, 663A–668A).

This approach can also be applied for purely organic compounds that are not polymeric. Combinatorial procedures for synthesis and selection for the desired binding properties have been described for such compounds (Weber et al. (1995) Angew.Chem.Int.Ed.Engl. 34, 2280–2282; G. Lowe (1995), Chemical Society Reviews 24, 309–317; L. A. Thompson et al. (1996) Chem. Rev. 96, 550–600). Once suitable binding compounds have been identified, they can be produced on a larger scale by means of organic synthesis.

Bleaching Enzyme

The optional bleaching enzyme may be a targeted bleaching enzyme as described in EP9803438. Alternatively, the bleaching enzyme may be bound to the organic substance and the recognising portion, which bind together. Conversely, the bleaching enzyme as provided in the bleaching composition may be free in solution. Preferably, the enzyme comprises an enzyme part capable of generating a bleaching chemical that is coupled to a recognising portion having a high binding affinity for stains present on fabrics.

Hydrogen peroxide may be generated in situ by using various enzymes, see WO-A-9507972. An example of a hydrogen peroxide producing enzyme is glucose oxidase. Glucose oxidase requires the presence of glucose to generate hydrogen peroxide. The glucose may be added to the bleaching composition or generated in situ with, for example, amylase that produces glucose from starch. The glucose oxidase may be present in a unit dose of the bleaching composition such that in the wash solution glucose oxidase is present at a concentration of 100 $\mu$g/l to 0.5 g/l together with 0.1 to 15% glucose, preferably 0.5% glucose. The glucose in the bleaching composition may be also generated in situ with for example amylase that produces glucose from starch, for further discussion the reader is directed to T. S. Rasmussen et al. in J. Sci. Food Agric., 52(2), 159–70 (1990).

If amylase is used for the generation of glucose it is preferred that starch is present in the wash at 0.1% concentration. Other examples of oxidases include, an amine oxidase and an amine, an amino acid oxidase and an amino acid, cholesterol oxidase and cholesterol, uric acid oxidase and uric acid or a xanthine oxidase with xanthine as found in WO9856885. A preferred hydrogen peroxide generating system is a C1–C4-alkanol oxidase in conjunction with a C1–C4-alkanol. A most preferred hydrogen peroxide generating system is the combination of methanol oxidase and ethanol. The methanol oxidase is preferably isolated from a catalase-negative Hansenula polymorpha strain, see for example EP-A-244 920. The preferred oxidases are glucose oxidase, galactose oxidase and alcohol oxidase.

Alternatively, peroxidases or laccases may be used. In this case the bleaching molecule is derived from an enhancer molecule that has reacted with the enzyme. Examples of laccase/enhancer systems are given in WO-A-95/01426. Examples of peroxidase/enhancer systems are given in WO-A-97/11217.

The Stains

For detergent applications, several classes of coloured substances one would like to bleach can be envisaged, in particular coloured substances that may occur as stains on fabrics can be a target. However, it is also important to emphasise that many stains are heterogeneous. Therefore, the substance to be targeted need not itself be coloured providing that it is always present in the mixture of substances that constitute a stain.

Moreover, an important embodiment of the invention is to use a binding compound that binds to several different, but structurally-related, molecules in a class of "stain substances". This would have the advantage of enabling a single enzyme species to bind (and bleach) several different stains. An example would be to use an antibody which binds to the polyphenols in wine, tea, and blackberry.

Further examples of classes of stain substances are given below:

Porphyrin Derived Structures

Porphyrin structures, often coordinated to a metal, form one class of coloured substances which occur in stains. Examples are heme or haematin in blood stain, chlorophyll as the green substance in plants, e.g. grass or spinach. Another example of a metal-free substance is bilirubin, a yellow breakdown product of heme.

Tannins, Polyphenols

Tannins are polymerised forms of certain classes of polyphenols. Such polyphenols are catechins, leuantocyanins, etc. (P. Ribéreau-Gayon, Plant Phenolics, Ed. Oliver & Boyd, Edinburgh, 1972, pp. 169–198). These substances can be conjugated with simple phenols like e.g. gallic acids. These polyphenolic substances occur in tea stains, wine stains, banana stains, peach stains, etc. and are notoriously difficult to remove.

Carotenoids (G. E. Bartley et al. (1995), The Plant Cell 7, 1027–1038). Carotenoids are the coloured substances which occur in tomato (lycopene, red), mango (β-carotene, orange-yellow). They occur in food stains (tomato) which are also notoriously difficult to remove, especially on coloured fabrics, when the use of chemical bleaching agents is not advised.

Anthocyanins (P. Ribreau-Gayon, Plant Phenolics, Ed. Oliver & Boyd, Edinburgh, 1972, 135–169). These substances are the highly coloured molecules that occur in many fruits and flowers. Typical examples, relevant for stains, are berries, but also wine. Anthocyanins have a high diversity in glycosidation patterns.

Maillard Reaction Products

Upon heating of mixtures of carbohydrate molecules in the presence of protein/peptide structures, a typical yellow/brown coloured substance arises. These substances occur for example in cooking oil and are difficult to remove from fabrics.

The Detergent Composition

The targeted bleach catalyst can be used in a detergent composition, specifically suited for stain bleaching purposes, and this constitutes a second aspect of the invention. To that extent, the composition comprises a surfactant and optionally other conventional detergent ingredients. The invention in its second aspect provides an enzymatic detergent composition which comprises from 0.1–50% by weight, based on the total detergent composition, of one or more surfactants. This surfactant system may in turn comprise 0–95% by weight of one or more anionic surfactants and 5–100% by weight of one or more nonionic surfactants. The surfactant system may additionally contain amphoteric or zwitterionic detergent compounds, but this in not normally desired owing to their relatively high cost. The enzymatic detergent composition according to the invention will generally be used as a dilution in water of about 0.05 to 2%.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system which is a mixture of an alkali metal salt of a $C_{16}$–$C_{18}$ primary alcohol sulphate together with a $C_{12}$–$C_{15}$ primary alcohol 3–7 EO ethoxylate.

The nonionic detergent is preferably present in amounts greater than 10%, e.g. 25–90% by weight of the surfactant system. Anionic surfactants can be present for example in amounts in the range from about 5% to about 40% by weight of the surfactant system.

The detergent composition may take any suitable physical form, such as a powder, an aqueous or non aqueous liquid, a paste or a gel.

The bleaching enzyme used in the present invention can usefully be added to the detergent composition in any suitable form, i.e. the form of a granular composition, a liquid or a slurry of the enzyme, or with carrier material (e.g. as in EP-A-258 068 and the Savinase (TM) and Lipolase (TM) products of Novo Nordisk). A good way of adding the enzyme to a liquid detergent product is in the form of a slurry containing 0.5 to 50% by weight of the enzyme in a ethoxylated alcohol nonionic surfactant, such as described in EP-A-450 702 (Unilever).

A unit dose of the bleaching composition of the present invention comprises an amount of a targeted bleach catalyst. The amount of the targeted bleach catalyst per unit dose used in bleaching is approximately 10 fold less than that of an equivalent non-targeted bleach catalyst of comparable activity.

The bleaching composition is preferably used in a laundry wash liquor, preferably an aqueous wash liquor. The amount of targeted catalyst in the composition according to the present invention is sufficient to provide a concentration in the wash liquor of generally 0.0005 $\mu$m to 5 mM, preferably from 0.005 $\mu$M to 10 $\mu$M, more preferably from 0.01 $\mu$M to 1 $\mu$M of an organic substance which forms a complex with a transition metal, the complex catalysing bleaching of a substrate.

The bleaching composition of the invention may optionally comprise about 0.001 to 10 milligrams of active bleaching enzyme per liter. A detergent composition will comprise about 0.001% to 1% of active enzyme (w/w).

The enzyme activity can be expressed in units. For example, in the case of glucose oxidase, one unit will oxidise 1 $\mu$mole of β-D-glucose to D-gluconolactone and $H_2O_2$ per minute at pH 6.5 at 30° C.

The enzyme activity that is added to the enzymatic bleaching composition will be about 2.0 to 4,000 units per liter (of wash liquor). A unit dose of the bleaching composition of the present invention may comprise an amount to provide 5 mg/l of enzyme in the diluted wash liquor.

The invention will now be further illustrated in the following, non-limiting Examples. As one skilled in the art will appreciate that a bleach catalyst with any suitable functionality may be linked to a suitable recognising portion.

Synthesis of a Functionalised Bleach Catalyst

Methyl 6-methylnicotinate N-oxide (13)

Methyl 6-methylnicotinate (10 g, 66.2 mmol) was dissolved in dichloromethane (150 ml). 3-Chloroperoxylbenzoic acid (17 g, 112 mmol) was added and the mixture was stirred for 3 h at room temperature. Saturated $NaHCO_3$ solution (200 ml) was added and the mixture was stirred for an additional hour. The dichloromethane layer was separated and the aqueous layer was extracted with dichloromethane (2×100 ml). The combined dichloromethane layers were washed with saturated $NaHCO_3$ (aq) (100 ml), brine (100 ml) and dried ($Na_2SO_4$). After evaporation of the solvent 13 (7.8 g, 51.0 mmol, 77%) was obtained as a cream coloured solid, mp 90.4–90.8° C. $^1$H-NMR ($CDCl_3$) δ2.52 (s, 3H), 3.90 (s, 3H), 7.32 (d, 1H, J=8.05 Hz), 7.70 (dd, 1H, J=8.05 Hz, J=1.1 Hz), 8.80 (d, 1H, J=1.1 Hz); HRMS calcd. for $C_8H_9NO_3$ 167.058, found 167.060.

Methyl 6-(chloromethyl)nicotinate (14)

p-Toluenesulfonyl chloride (10.7 g, 56.1 mmol) was combined with 13 (7.8 g, 51.0 mmol) in dioxane (100 ml) under an Argon atmosphere. The reaction mixture was heated under reflux for 1 night. After cooling to room temperature the solvent was evaporated and the residue dissolved in dichloromethane (200 ml). The solution was washed with saturated $Na_2CO_3$ (aq) (2×100 ml), brine (50 ml) and dried ($Na_2SO_4$). After evaporation of the solvent the product was purified by column chromatography (SiO2, hexane/ethyl acetate 10:2.5) to give 14 (5.71 g, 30.8 mmol, 60%) as a slightly yellow solid. An analytically pure sample could be obtained by recrystallization from n-hexane, mp 63.5–63.8° C.; $^1$H-NMR ($CDCl_3$) δ3.94 (s, 3H), 4.70 (s, 2H), 7.58 (d, 1H, J=8.4 Hz), 8.30 (dd, 1H, J 8.1 Hz, J=2.2 Hz), 9.08 (d, 1H, J=1.5 Hz); Anal. Calcd. for $C_8H_8ClNO_2$: C 51.77, H 4.34, N 7.55; found: C 51.50, H 4.23, N 7.46.

6-(((di-pyridin-2-yl-methyl)-pyridin-2-ylmethyl-amino)-methyl)nicotinic Acid Methyl Ester (15)

A solution of N3Py (1.45 g, 5.3 mmol), 14 (1.08 g, 5.8 mmol) and N,N-diisopropylethylamine (1.3 ml, 7.5 mmol) in acetonitrile (20 ml) was heated under reflux overnight, under an Argon atmosphere. After cooling to room temperature the solvent was evaporated and the residue was purified by column chromatography ($Al_2O_3$ neutral akt. I, ethyl acetate/triethylamine 10:1) to give 15 (1.96 g, 84%) as a dark oil. $^1$H-NMR ($CDCl_3$) δ3.91 (s, 3H), 3.95 (s, 2H), 4.05 (s, 2H), 5.33 (s, 1H), 7.11 (m, 3H), 7.65 (m, 7H) 8.20 (m, 1H), 8.48 (d, 1H, J=4.9 Hz), 8.56 (d, 2H, J=4.9 Hz), 9.06 (d, 1H, J=2.2 Hz); $^{13}$C NMR ($CDCl_3$) δ52.17 (q), 57.18 (t), 57.56 (t), 72.31 (d), 121.91 (d), 122.19 (d), 122.21 (d), 122.39 (d), 123.04 (d), 123.93 (d), 124.06 (s), 136.33 (d), 137.32 (d), 149.12 (d), 149.34 (d), 150.20 (d), 159.42(s), 159.82 (s), 164.97 (s), 166.13 (s); MS (CI): m/z 426 (M+1).

N-(3-amino-propyl)-6-(((di-pyridin-2-yl-methyl)-pyridin-2-ylmethyl-amino)-methyl)nicotinamide (16)

A solution of 15 (473 mg, 1.11 mmol), 1,3-diaminopropane (1.1 ml, 13.1 mmol) and NaCN (7 mg, 0.14 mmol) in methanol (15 ml) was heated under reflux for 24 hours under an Argon atmosphere. After cooling to room temperature the mixture was poured into water (100 ml) and the aqueous layer was washed with ether (2×125 ml), followed by extraction with dichloromethane (3×75 ml). The combined dichloromethane layers were washed with water (50 ml), brine (50 ml) and dried ($Na_2SO_4$). Evaporation of the solvent afforded 16 (418 mg, 81%) as a slightly yellow sticky solid. $^1$H-NMR ($CDCl_3$) δ1.71 (m, 2H), 2.91 (m, 2H), 3.54 (m, 2H), 3.91 (s, 2H), 3.96 (s, 2H), 5.29 (s, 1H), 7.09 (m, 3H), 7.60 (m, 7H), 8.03 (m, 1H), 8.43 (d, 1H, J=4.4 Hz), 8.52 (d, 2H, 4.8 Hz), 8.85 (s, 1H); $^1$H-NMR ($CDCl_3$) δ30.41 (t), 39.34 (t), 40.51 (t), 56.79 (t), 57.14 (t), 71.86 (d), 121.81(d), 122.07 (d), 122.35 (d), 122.86 (d), 123.82 (d), 128.36 (s), 135.39 (d), 136.23 (d), 136.29 (d), 147.42 (d), 148.95 (d), 149.18 (d), 159.27 (s), 159.58 (s), 162.58 (s), 165.33(s); MS (CI): m/z 468 (M+1).

Below is given a schematic illustrating steps in the aforementioned synthesis.

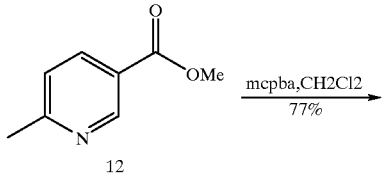

12

-continued

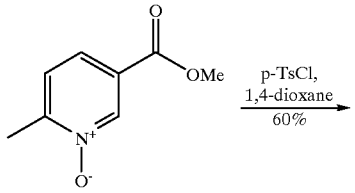

13

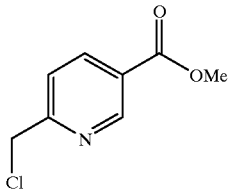

14

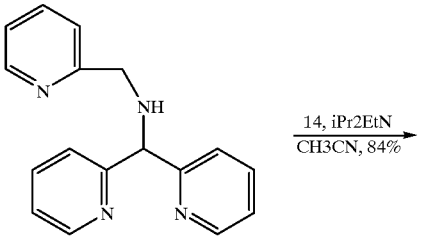

10

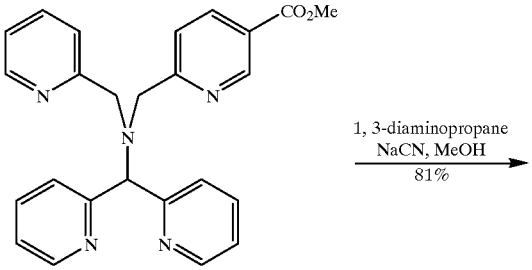

15

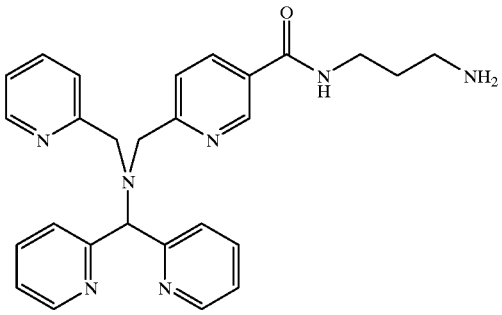

16

The Following are Examples of Coupling of an Organic Substance (Ligand) to an Antibody The following techniques described herin for coupling an antibody protein to the functional amine group on the catalyst was performed with appropriate modification of that described in 'Bioconjugate techniques' by G. T. Hermanson. There are a magnitude of homo-bifunctional and hetero-bifunctional cross linkers that are commercially available to couple functional groups of a protein to functional groups such as amines or carboxyl groups on a second molecule or moiety.

As will be evident to one skilled in the art it is possible to switch the functional groups utilised for coupling, i.e., the antibody may be coupled via amine or carboxylate groups.

In the aforementioned couplings of an organic substance (ligand) to an antibody, such examples of suitable antibody are found in EP 9803438.

Experimental Protocol—Conjugating the Catalyst to Antibody Molecules

The antibody (VHH) molecules as described herein are denoted 2E3 (single antibody fragment) or 10-2E3 (double bi-head antibody fragment) and have the ability to bind to tomato stain. The designations VHH, 2E3, and 10-2E3 are arbitrary to the practitioner. These antibodies were generated by injecting a llama with an antigen followed by isolating the antibodies generated by the Llamas immune response system. The antigen is the molecular species that it is desirous to target for example a common component in tomato strain. The generation of antibody llama antibodies from llama blood serum will be evident to one skilled in the art as routine, see for example EP0736544 and WO9714719. Three methods of linking the antibody to the catalyst will now be described.

(Method 1) Hetro-bifunctional Cross-linking Using SAMSA/SPDP

This method describes the use of S-Acetylmercaptosuccinic anhydride (SAMSA) to functionalise the antibody, and then coupling to the catalyst which has been functionalised with Sulphosuccinimidyl 6-[3'-(2-pyridylithio)-priopioamido] heaxanoate (Sulfo-LC-SPDP)

Labelling of 2E3 or 10-2E3 with SAMSA

Reagents

SAMSA (S-Acetylmercaptosuccinic anhydride) [Sigma]

Dimethyl Formamide 0.1M Na P buffer pH 6.5

0.1M Na P, 5 mM EDTA pH 6.5

0.1 M EDTA 0.1M Tris pH 7.0

1M $NH_2$ OH pH 7.0

Antibody at ~7.5 mg/ml in 0.1M Na P (sodium phosphate) buffer pH 6.5

1. The antibody was buffer exchanged into 0.1 M Na P buffer pH 6.5 and the protein concentration determined with a BCA protein assay. (~7.5 mg/ml).
2. 2 ml of antibody was dispensed into a reactivial. SAMSA was made up at 20 mg/ml in DMF and 400 $\mu$l was added to the antibody. The reaction mixture was stirred rapidly for 40 minutes at room temperature, after which the following was added having been prepared in the following manner: 0.1 M EDTA 1.6 ml/stirred for 5 min. 0.1 M Tris pH 7.0/2 ml and stirred for 5 min. and finally 1.6 ml of 1M $NH_2OH$ and stirred for 5 min.
3. The labelled antibody mixture was then dispensed into a centricon concentrator fitted with a 10 kDa membrane. To this was added 5 ml of 0.1M Na P, 5 mM EDTA pH 6.5 and centrifuged to remove any unreacted cross linker and any excess 1M $NH_2OH$. When the volume had reduced to ~2 ml by centrifugation a further 1 ml of 0.1M Na P and 5 mM EDTA was added after which the volume was further reduced by centrifugation.

Labelling of Catalyst with SPDP

Reagents

Sulfo-LC-SPDP (Pierce)

0.1 M Na P pH 7.5

Catalyst (The term coordinated catalyst as used herein means that the iron has been bound to the linker-N4py ligand. The catalyst has been made as follows: equimolar amounts of N4py-linker (compound 16) dissolved in methanol and an aqueous iron perchlorate solution has been mixed (H2O:methanol=1/1), after which a few drops of acetonitrile has been added. The colour of the solution becomes reddish, typical for the [Fe(II)(N4py)(CH3CN)]2+ species (reference: M. Lubben et al., Angew Chem., 34, 1512, 1995).

1. Catalyst was dissolved into acetonitrile ~[40 mg/ml], from which 50 μl was removed and dispensed into a reactivial with 300 μl of 0.1M Na P pH 7.5. To this was added 1 mg of Sulfo LC-SPDP and stirred at room temperature for 30 minutes.
2. The resultant catalyst reaction mixture was added to a PD 10 column (desalting chromatography column) pre-equilibrated in 0.1M Na P buffer pH 6.5. Collected fractions containing the catalyst were combined.

Conjugation of Functionalised Antibody to Functionalised Catalyst

1. Added 100 μl of 0.1M EDTA to the concentrated antibody followed by the fractions containing LC-SPDP functionalised catalyst.
2. This was mixed by inverting the glass vial and placed at 4° C. Conjugation will occur within hours.
3. The mixture was dispensed into a centricon concentrator with a 10 kDa membrane and centrifuged to remove any unconjugated catalyst.

(Method 2) Hetro-bifunctional Cross Linking Using EDC/NHS

Coupling the antibody molecule to the catalysts was also performed using 91-ethyl-3-[3-dimethylaminopropyl] carbodiimide hydrochloride (EDC)/N-hydroxysulpho succinamide (NHS) chemistry. This established literature method results in the formation of amide bonds.

The conjugation approach was performed using EDC/NHS in a indirect (method A) or direct (method B) approach described below:

Method A. EDC/NHS Indirect

Materials

Antibody 2E3 or 10-2E3 at 10 mg/ml in 0.1M MES, 0.015M Nacl
pH 6.0
Catalyst solution at 30 mg/ml
EDC solution 0.2M
NHS solution 0.5M
Reactivial and stirrer
Microcon concentrators [Nalgene]
0.1M Na phosphate buffer pH 7.2

Antibody was added to the reactivial to give a total of 1 mg, to this the following were added: 10 μl of EDC solution and 10 μl of NHS solution. The volume was made up to 1 ml with 880 μl of 0.1M MES 0.015M NaCl. This mixture was incubated at room temperature [20° C.±1] for 15 minutes before the excess unreacted EDC/NHS was removed by centrifugation in a microcon fitted with a 10 kDa membrane and buffer exchanged into 0.1M Na phosphate pH 7.5.

The volume of liquid after this process was 500 μl, which was dispensed into a clean reactivial. A 33 μl aliquot of catalyst solution was added to 167 μl of 0.1 m phosphate buffer pH 7.2 to give a 5 mg/ml concentration, this was then added to the reactivial containing the antibody. The reaction with the antibody (vhh) was carried out for 2 hours at room temperature. During this step the concentration of the antibody (vhh) was 1 mM, and the catalyst at 15 mM. After incubation the excess catalyst was removed by centrifugation in a microcon concentrator fitted with a 10 kDa membrane. Phosphate buffer was then added in 500 μl aliquots until 2 mls had been added in total. The filtrate and retentate were stored at +40C.

Method B. EDC/NHS Direct

Materials

Antibody 2E3 or 10-2E3 at 10 mg/ml in 0.1M Na phosphate, 0.15M Nacl pH 7.2
Catalyst solution at 30 mg/ml
EDC solution 0.2M
NHS solution 0.5M
Reactivial and stirrer
Microcon concentrators [Nalgene]
0.1M Na phosphate buffer pH 7.5

A 100 μl aliquot of antibody was dispensed to a reactivial and 11 μl of the catalyst solution was added. The EDC and NHS solutions were added with 0.1M Phosphate buffer to bring the volume to 1 ml. The final concentrations of EDC and NHS were 50 mM and 5 mM, respectively. The mixture was reacted by stirring for 2 hours at room temperature. Excess catalyst and EDC/NHS was removed by centrifuging the mixture in a centricon fitted with a 3 kDa membrane. This was followed by dialysis (10 kDa membrane) against 0.1M Phosphate 0.15 M NaCl.

(Method 3) Homo-bifunctional Cross Linking Glutaraldehyde

Glutaraldehyde is the most common cross linking agent for protein modification. This homo-bifunctional cross-linker has the disadvantage of being difficult to control. Many molecular weight species are formed and this makes analysis difficult.

1. Glutaraldehyde (GA) was added to the catalyst and bihead (10-2E3). This was performed twice, one with a high concentration of bihead, one with a lower concentration of bihead.

The high and low Bihead concentration samples for conjugation experiments were as follows:

High Concentration Experiment

The following levels of bi-head and catalyst were used,
Bi-head 7.5 mg/ml
Catalyst 0.3 mg/ml These were combined and mixed before 8.4 μl of 5% glutaraldehyde was added.

The conjugation was carried out for 5 minutes before precipitated protein was removed by spinning and the soluble fraction was dialysed against PBS overnight with a 10 kDa membrane.

Low Concentration Experiment

The following levels of bi-head and catalyst were used,
Bi-head 2.6 mg/ml
Catalyst 1.1 mg/ml (~40 times molar excess)

These were combined and stirred to mix well before 8.4 μl of 25% Glutaraldehyde was added.

This quickly resulted in the clear colourless liquid turning opaque with a pale yellow colour. The mixture was stirred for 20 minutes before being spun at 7,000 RPM in a microfuge for 5 minutes. A heavy yellow precipitate was collected at the bottom of the tube and a clear colourless solution. The solution was removed and dialysed with a 10 kDa membrane overnight against PBS.

3. The second batch gave a heavy precipitate within 10 minutes of GA being added. For the first batch, lower cross linker concentrations and lower catalyst concentrations were used, and this resulted in reduced precipitation.
4. Both mixtures were spun for 10 minute to remove the precipitated antibody. The antibody/catalyst solution was dialysed in 10 kDa membrane overnight against PBS to remove any unbound catalyst.

Determination of Antibody Binding Activity

Once the conjugates were constructed (using the three methods described above) they were tested for antibody activity. The material used in this assay is the conjugate material with molecular weight greater than 10 kDA. This should therefore be devoid of unconjugated catalyst.

A microtitre plate was sensitised by dispensing 200 μl/well of tomato paste diluted in 0.05M carbonate buffer pH 9.8 and incubation at 37° C overnight. Before use, the plate was washed with PBST and blocked with 200 μl/well of PBST containing 1% ovalbumin and 1% Skimmed milk powder for 45 minutes.

A positive control of VHH 2E3 was prepared to give the following concentrations, 200,100, and 50,25,12.5,6.25 μg/ml and applied at 100 μl/well in duplicate. The conjugates were diluted at 1/20, 40,80,160,320,640 and applied to sensitised wells at 100 μl/well in duplicate. Incubation was carried out for 1 hour at room temperature. Unbound material was removed by washing the wells with three changes of PBSTM. Rabbit anti llama (IgG) was diluted at 1/100 in blocking buffer and dispensed to the wells, incubation proceeded for 1 hour at room temperature. Following this step the wells were again washed with three changes of PBST to remove unbound material. Goat anti rabbit conjugated to alkaline phosphatase was diluted 1/1000 in PBST and dispensed at 100 μl/well, incubation was carried out for 1 hour. Finally the plate was washed with four changes of PBST and pNPP substrate in 1M DEA+1 mM MgCl and applied at 100 μl/well. When a chromogenic colour was sufficiently developed, the plate was then measured at 405 nm and data plotted on a graph. This data is presented in Table 1.

TABLE 1

2E3-catalyst conjugate activity binding to tomato stain. This table demonstrates antibody activity in 2E3-catalyst conjugates.

| dilution | 200 | 100 | 50 | 25 | 12.5 | 6.25 |
|---|---|---|---|---|---|---|
| VHH 2E3 | 1.575 | 1.278 | 1.186 | 1.138 | 1.1 | 1.04 |
| | 1.254 | 1.174 | 1.124 | 1.041 | 0.981 | 0.969 |
| Ave | 1.4145 | 1.226 | 1.155 | 1.0895 | 1.0405 | 1.0045 |
| Std. dev | 0.226981 | 0.073539 | 0.043841 | 0.068589 | 0.084146 | 0.050205 |
| | 20 | 40 | 80 | 160 | 320 | 640 |
| Indirect NHS/EDC method | 1.096 | 1.138 | 1.135 | 1.211 | 1.163 | 1.065 |
| | 1.058 | 1.024 | 1.064 | 1.163 | 1.06 | 0.953 |
| Ave | 1.077 | 1.081 | 1.0995 | 1.187 | 1.1115 | 1.009 |
| Std. dev | 0.02687 | 0.08061 | 0.050205 | 0.033941 | 0.072832 | 0.079196 |
| Direct NHS/EDC method | 1.332 | 1.211 | 1.123 | 1.037 | 0.897 | 0.848 |
| | 1.31 | 1.167 | 1.064 | 1.014 | 0.899 | 0.826 |
| Ave | 1.321 | 1.189 | 1.0935 | 1.0255 | 0.898 | 0.837 |
| Std. dev | 0.015556 | 0.031113 | 0.041719 | 0.016263 | 0.001414 | 0.015556 |
| LC-SPDP Method | 1.304 | 1.164 | 1.033 | 0.914 | 0.696 | 0.546 |
| | 1.294 | 1.148 | 1.018 | 0.93 | 0.723 | 0.565 |
| Ave | 1.299 | 1.156 | 1.0255 | 0.922 | 0.7095 | 0.5555 |
| Std. dev | 0.007071 | 0.011314 | 0.010607 | 0.011314 | 0.019092 | 0.013435 |
| Background | 0.116 | 0.119 | 0.111 | 0.108 | 0.105 | 0.111 |

These results indicate that the higher molecular weight material contains antibody-binding activity using 2E3 antibody—catalyst conjugate samples.

Conjugates using the bihead antibody and the catalyst were also tested. The activities in conjugate samples (10-2E3-catalyst conjugates) are shown in Table 2.

The assay materials in this assay were as described for results in Table 1 with appropriate modification. The conjugate samples were diluted and applied to plate for 30 minutes before being washed. Bound bihead was detected with Rabbit ant Llama that was applied for 30 minutes. Again plates were washed and anti rabbit Alk-phos conjugate was applied for 30 minutes. After washing pNPP substrate was added and plates were read after ~30 minutes.

TABLE 2

10-2E3-catalyst conjugate binding activity to tomato stain

| dilution | 20 | 10 | 5 | 2.5 | 1.25 |
|---|---|---|---|---|---|
| Control | 1.011 | 0.967 | 0.8 | 0.774 | 0.59 |
| | 0.843 | 0.979 | 0.931 | 0.814 | 0.723 |
| Average | 0.927 | 0.973 | 0.8655 | 0.794 | 0.6565 |
| Std. Dev | 0.118794 | 0.008485 | 0.092631 | 0.028284 | 0.094045 |
| | 4 | 8 | 16 | 32 | 64 |
| GA high concentration | 0.937 | 0.847 | 0.65 | 0.503 | 0.62 |
| | 0.947 | 0.79 | 0.723 | 0.569 | 0.414 |
| Average | 0.942 | 0.8185 | 0.6865 | 0.536 | 0.517 |
| Std. Dev | 0.007071 | 0.040305 | 0.051619 | 0.046669 | 0.145664 |
| GA low Concentration | 1.006 | 1.096 | 0.919 | 0.85 | 0.738 |
| | 1.012 | 0.887 | 0.861 | 0.714 | 0.662 |
| Average | 1.009 | 0.9915 | 0.89 | 0.782 | 0.7 |
| Std. Dev | 0.004243 | 0.147785 | 0.041012 | 0.096167 | 0.05374 |
| NHS/EDC Method | 0.999 | 1.017 | 0.983 | 1.029 | 1.02 |
| | 0.933 | 1.083 | 1.117 | 1.005 | 0.858 |
| Average | 0.966 | 1.05 | 1.05 | 1.017 | 0.939 |
| Std. Dev | 0.046669 | 0.046669 | 0.094752 | 0.016971 | 0.114551 |

These results indicate that the higher molecular weight material contains antibody-binding activity using 10-2E3 antibody—catalyst conjugates.

Determination of Catalyst Activity by Evaluating Bleaching Activity—Stain Bleaching Test Once the conjugates were constructed they were tested for catalyst bleaching activity. The material used in this assay is the conjugate material with a molecular weight greater than 10 kDA and should therefore be devoid of unconjugated catalyst.

Samples of 10-2E3-Catalyst (Co-ordinated) and the dialysed Glutaradehyde conjugates were spotted onto oily tomato cloth. The bleaching results were obtained were indicative of an active bleaching species. Bleaching zones (white halos in a red stain surrounding) were created on the tomato stained cloth. This demonstrated that the conjugated material possesses catalyst bleaching activity. The conjugation of the antibody to the catalyst using low concentrations of glutaraldehyde gave the strongest bleaching zones.

The data taken in combination for the antibody binding activity and catalyst bleaching activity indicate that the higher molecular weight conjugates formed do have the ability to bind to tomato stain and possess the ability to bleach the chromophore via the catalyst activity.

Key to Abbreviations Used in Text of Examples (Not Provided in Text)

DMF=Dimethyl Formamide
Na P=sodium Phosphate
EDTA=Ethylenediaminetetraacetic acid
PBS=Phosphate Buffered Saline
PBST=Phosphate Buffered Saline Tween 20
PBSTM=Phosphate Buffered Saline Tween 20 Methiolate
$NH_2OH$=Hydroxylamine
Vhh=antibody fragment, variable heavy-heavy
pNPP=para-Nitrophenyl PyroPhosphate
DEA=Diethylamine
MgCl=Magnesium Chloride
MES=2-[N Morpholino]ethanesulphonic acid
IgG=Immunoglubin molecule class G.

What is claimed is:

1. A bleaching composition comprising an organic substance which forms a complex with a transition metal, the complex catalysing bleaching of a substrate by a precursor selected from atmospheric oxygen, a peroxyl species and a peroxyl species precursor, characterised in that the bleaching composition comprises a recognising portion having a high binding affinity for stains present on a fabric and being selected from the group consisting of an antibody, a protein, a peptide, an antibody and a fragment, and a diabody, wherein in an aqueous solution the organic substance and the recognising portion bind together.

2. A bleaching composition according to claim 1, wherein the recognising portion is an antibody and the organic substance is covalently bound to the antibody.

3. A bleaching composition according to claim 1, wherein the recognising portion is an antibody and the organic substance is non-covalently bound to the antibody in solution.

4. A bleaching composition according to claim 1, wherein the recognising portion is an antibody and the organic substance and the antibody are bound together via an enzyme, protein or peptide linkage in solution.

5. A bleaching composition according to claim 1, wherein the recognising portion has a high binding affinity for a structure selected from porphyrin derived structures, tannins, polyphenols, carotenoids, anthocyanins, and maillard reaction products.

6. A bleaching composition according to claim 1, further comprising a bleaching enzyme capable of generating a bleaching chemical and having a high binding affinity for stains present on fabrics.

7. A bleaching composition according to claim 1, wherein the recognising portion having a high binding affinity is a protein or a peptide.

8. A bleaching composition according to claim 1, wherein the recognising portion having a high binding affinity is an antibody or antibody fragment.

9. A bleaching composition according to claim 1, comprising an organic substance which forms a complex with a transition metal and all or part of a heavy chain immunoglobulin that was raised in Camelidae and has a specificity for stain molecules.

10. A bleaching composition according to claim 1, wherein the recognising portion having a high binding affinity has a chemical equilibrium constant $K_d$ for the substance of less than $10^{-4}$ M.

11. A bleaching composition according to claim 10, wherein the chemical equilibrium constant $K_d$ is less than $10^{-7}$ M.

12. A bleaching composition according to claim 1, wherein recognising portion is tethered to a N-(3-aminopropyl)-6-(((di-pyridin-2-yl-methyl)-pyridin-2-ylmethylamino)-methyl) moiety.

13. A bleaching composition according to claim 1, wherein the composition comprises less than 1%, by molar weight on an oxygen basis, of peroxygen bleach or peroxy-based or -generating bleach system.

14. A bleaching composition according to claim 1, wherein the composition comprises a peroxyl species in the range 4 to 20% wt/wt.

15. A bleaching composition according to claim 1, wherein the recognising portion is a bispecific antibody, an antibody fragment, or a diabody arranged so that one specificity is directed to stains present on fabrics and the other is directed to the organic substance which forms a complex with a transition metal.

16. A method of bleaching a substrate comprising applying to the substrate, in an aqueous medium, the bleaching composition according to claim 1.

17. A commercial package comprising the bleaching composition according to claim 1 together with instructions for its use.

* * * * *